United States Patent [19]

Murayoshi

[11] Patent Number: 4,568,074

[45] Date of Patent: Feb. 4, 1986

[54] AUTOMATIC SHEET FEEDING APPARATUS

[75] Inventor: Seiji Murayoshi, Tokyo, Japan

[73] Assignee: Ricoh Company, Ltd., Japan

[21] Appl. No.: 277,984

[22] Filed: Jun. 26, 1981

[30] Foreign Application Priority Data

| | | | |
|---|---|---|---|
| Jun. 30, 1980 | [JP] | Japan | 55-088745 |
| Jun. 30, 1980 | [JP] | Japan | 55-088746 |
| Jun. 30, 1980 | [JP] | Japan | 55-088747 |
| Jun. 30, 1980 | [JP] | Japan | 55-088748 |
| Jun. 30, 1980 | [JP] | Japan | 55-091652[U] |

[51] Int. Cl.[4] ..... B65H 3/56; B65H 1/06

[52] U.S. Cl. ..... 271/121; 271/119; 271/171; 271/144; 271/167; 271/137

[58] Field of Search ..... 271/118, 119, 121, 122, 271/124, 125, 104, 171, 144, 223, 224, 238, 240, 253, 254, 255, 167, 137, 138

[56] References Cited

U.S. PATENT DOCUMENTS

| | | | |
|---|---|---|---|
| 757,484 | 4/1904 | McGirr et al. | 271/125 |
| 1,097,750 | 5/1914 | Cheshire | 271/23 |
| 1,515,986 | 11/1924 | Wright et al. | 271/125 |
| 1,596,056 | 8/1926 | Mader | 271/124 |
| 1,637,833 | 8/1927 | Mueller | 271/124 |
| 2,222,984 | 11/1940 | Marchen | 271/37 |
| 2,398,315 | 4/1946 | Little | 271/253 |
| 2,635,874 | 4/1953 | La Bore | 271/125 |
| 2,660,431 | 11/1953 | Levin | 271/253 |
| 2,726,862 | 12/1955 | Anderson | 271/124 |
| 2,785,893 | 3/1957 | Ford et al. | 271/171 |
| 3,022,997 | 2/1962 | Pendley | 271/171 |
| 3,486,749 | 12/1969 | Billings | 271/114 |
| 3,771,783 | 11/1973 | McInerny | 271/122 |
| 3,807,725 | 4/1974 | Bookless | 271/171 |
| 3,933,350 | 1/1976 | Mignano | 271/125 |
| 3,991,998 | 11/1976 | Banz et al. | 271/125 |
| 4,010,883 | 3/1977 | Ritter | 271/274 |
| 4,045,015 | 8/1977 | Sardella | 271/119 |
| 4,061,328 | 12/1977 | Fujimoto et al. | 271/121 |
| 4,062,533 | 12/1977 | Greenberg et al. | 271/10 |
| 4,099,484 | 7/1978 | Ohno | 271/240 |
| 4,219,191 | 8/1980 | Rastorguyeff | 271/171 |
| 4,268,021 | 5/1981 | Rutishauser et al. | 271/116 |
| 4,284,269 | 8/1981 | Ignatjev | 271/122 |
| 4,313,598 | 2/1982 | Di Blasio | 271/37 |
| 4,324,396 | 4/1982 | Albright et al. | 271/125 |
| 4,373,711 | 2/1983 | Foster et al. | 271/171 |

FOREIGN PATENT DOCUMENTS

| | | | |
|---|---|---|---|
| 229606 | 10/1963 | Austria | 271/119 |
| 2320319 | 3/1975 | Fed. Rep. of Germany | 271/124 |
| 2618089 | 11/1977 | Fed. Rep. of Germany . | |
| 55-31755 | 3/1980 | Japan | 271/122 |
| 0048138 | 4/1980 | Japan | 271/122 |
| 55-52836 | 4/1980 | Japan | 271/121 |
| 19703 | 1/1910 | Sweden | 271/121 |
| 530878 | 12/1940 | United Kingdom | 271/171 |
| 2041335 | 9/1980 | United Kingdom | 271/122 |
| 2057404 | 4/1981 | United Kingdom . | |

OTHER PUBLICATIONS

IBM Tech. Disc. Bull., vol. 18, No. 7, Dec. 1975, Colglazier et al.

IBM Tech. Disc. Bull., vol. 19, No. 6, Nov. 1976, Fallon et al.

Xerox Disc. Jol., vol. 4, No. 5, Oct. 1979, Riley.

*Primary Examiner*—Duane A. Reger
*Assistant Examiner*—James E. Barlow
*Attorney, Agent, or Firm*—Guy W. Shoup

[57] ABSTRACT

An automatic sheet feeding apparatus permits a choice between an automatic feed mode in which sheets disposed in a stack on a sheet receiving table can be sequentially separated and fed one by one from the bottom of the stack, and a manual feed mode in which a single sheet is manually fed. The sheet separation from the stack occurs by utilizing a separating roller which rotates in a direction in which the sheet is fed, and brake device which is disposed in abutment against the separating roller. The manual feed mode is enabled when the brake device is moved away from the separating roller.

10 Claims, 32 Drawing Figures

AUTOMATIC SHEET FEEDING APPARATUS

BACKGROUND OF THE INVENTION

An automatic sheet feeding apparatus is used to supply originals or sheets disposed in a stack on a sheet receiving table to a processor such as a reader in a facsimile system or an exposure station of a copying machine by separating the sheets into single sheets. A variety of sheet separating and feeding systems are known to separate and supply sheets from a stack. In one scheme called bottom-fed type, sheets are sequentially fed one by one from the bottom of the stack disposed on the sheet receiving table. An apparatus of such type is provided with a separating mechanism which typically comprises a separating roller having part of its peripheral surface projecting above the sheet receiving surface of the table for contact with a lowermost one of the sheets in the stack, and a separating member, for example, a brake member, which is disposed in abutment against the separating roller. The sheet separation takes place by the different magnitudes of the coefficient of friction between the separating roller and the sheet, between adjacent sheets or between the sheet and the brake member. Even if the stack contains sheets of different qualities such as those varying in thickness, the apparatus is normally capable of separating and feeding them.

However, in facsimile systems and copying machines, originals may be used which are curled, wrinkled, have a very thin or very thick thickness or have photographs applied thereto. When the described separat is used to feed such sheets which may vary widely, jamming may occur at the location of the mechanism. Alternatively, more than one sheet may be fed in superposed relationship, resulting in a failure to feed a single sheet. Accordingly, whenever such sheets must be fed, it is necessary to feed such sheets one by one manually rather than by utilizing an automatic feeding mechanism. Consequently, a sheet passage must be provided to enable a manual feeding, separately from a sheet passage in which the separating mechanism is disposed. This results in an increased size and a complex arrangement of the apparatus.

The brake member and the separating roller typically define a wedge-shaped space therebetween, into which the leading end of a plurality of sheets may advance, whereupon a lowermost one of the sheets which contacts the separating roller is fed alone while upper sheets are stopped by the brake member. The separated sheet is conveyed to a processor, but when that sheet is subject to a conveying effort by the processor, it may drive the brake member in a direction to move it away from the separating roller, thus, reducing the pressure of contact therebetween. If the next lowermost sheet is present in the wedge-shaped space, the reduction in the pressure of contact between the brake member and the separating roller in combination with the friction of the moving lowermost sheet may cause the next lowermost sheet to be fed in following relationship with the lowermost one, thus disavantageously causing an overlapping feed.

The sheets in the stack are adapted to be delivered to the nip between the brake member and the separating roller in a manner such that the leading edge of a lower sheet goes forwardly of the leading edge of another sheet which is located immediately above the first sheet. However, the sheets disposed on the table are subject to a limitation on the height of the stack. In the prior art practice, a lateral sheet guide which guides the lateral edge of the sheets or a sidewall of the table may be provided with a painted line, groove or or a label which indicates the limiting height of the stack. Alternatively, no indication may be provided, and instead a written notice is given on the table or nearby to indicate the permissible height of the stack and the number of sheets in the stack. However, these indications may be difficult to recognize, giving rise to the likelihood that the sheets may be stacked beyond the limit. The provision of a special indication in the form of a painted line, imprint or labelling increases the cost of the apparatus.

It is also to be noted that an apparatus of the type described is often provided with a pair of cross sheet guides between which the sheets of the stack are disposed and guided in the sheet feeding direction so that a skewing of the sheets may be prevented. Sheets being fed may have a variety of sizes, and accordingly the cross sheet guides must be provided in a displaceable manner to accommodate for sheets of varying sizes. In one arrangement which permits a change in the spacing between the cross sheet guides, the pair of cross guides are displaceable in a direction perpendicular to the sheet feeding direction so that the guides are aligned with the lateral edges of the sheets. In another arrangement, the cross sheet guides are brought into registry with a scale provided on the table and indicating various sheet sizes. Because this requires a manual operation by an operator, the guides may be urged forcibly or under pressure against the lateral edges of the sheets. This causes a loading on the sheets when the latter is to be fed, which may cause a failure to feed a sheet. When the guides are brought into registry with the scale, a skewing may result if a proper registration is not achieved. Additionally, some external forces may be unnoticeably applied to the sheets placed on the table or to the cross sheet guides to displace the sheet from a proper feeding position, again causing a skewing, a jamming or the failure to feed a sheet.

As a further consideration, an automatic sheet feeding apparatus of the bottom-fed type must be provided with some means which assures that the sheets in the stack will be subject to a friction exerted by the separating roller. In one form, such means may apply a pressure to the sheets of the stack from above, thus assuring the necessary friction. However, the magnitude of such friction or conveying force changes as the stack elevation varies, resulting in the disadvantage that an increased number of sheets cannot be placed in one stack while assuring a satisfactory separation and feeding.

In another known arrangement, the table is disposed at an angle as viewed in the sheet feeding direction so that the sheets placed in a stack thereon may slip over the table by gravity until their leading ends move into the nip between the separating roller and the brake member. However, when the table is disposed at an angle, the slip of the sheets in the sheet feeding direction may cause a concentration of sheets in the nip, inducing a failure to separate the sheets and increasing the tendency to produce an overlapping feed. On the other hand, when the table is disposed at a reduced angle, the friction acting between the separating roller and the sheets may be insufficient to assure a satisfactory feeding force, again resulting in the failure to feed a sheet. This occurs noticeably, in particular, when the separating roller also serves as a sheet feed roller. In addition, the smoothness or the weight of the sheets may vary depending upon the kind of sheets, and hence if the table is disposed at a given angle, it is very difficult to assure a feeding force of a given magnitude. If the angle of inclination of the table is adjustable, the arrangement cannot be easily changed to accommodate a stack having a mixture of different kinds of sheets. Another factor which further complicates the situation is the planarity of the sheets. Many sheets often contain wrinkles, a waviness, or an upward or downward warp, representing a departure from perfect planarity. Consequently, it is a rare occurrence that the leading end of the sheets in the stack will be brought into the nip between the separating roller and the brake member in a sequentially retrograde manner from the bottom or in alignment with each other. Rather, the stress in the sheets or the rigidness of the sheets may prevent the leading end of the sheets from reaching the nip, thus disabling the feeding operation or causing a fold or damage to be produced in the leading end if the feeding operation is attempted. If a fold is formed in the leading end of the sheet, it is very likely that a multiple feed results. Also, an apparatus of the bottom-fed type often has a problem in connection with the generation of static electricity, which may increase the tendency of inducing a multiple feed even if small in magnitude.

Accordingly, it is desirable that the sheet receiving table be disposed in a substantially horizontal position and that the separating roller be separate from the feed roller. When the table is disposed horizontally and a sheet feed roller is separately provided for feeding the leading end of sheets into the nip between the separating roller and the brake member, above disadvantages can be eliminated. However, the force of friction acting between the feed roller and the sheet which contacts it may become insufficient to assure a reliable feeding operation. To accommodate for this, vacuum means may be disposed below the table to attract the lowermost one of the sheets to the table, thus assuring a sufficient magnitude of the force of friction. However, since the feed roller has its peripheral surface partly projecting above the sheet receiving surface of the table, there is a likelihood that when sheets are placed on the table, the leading end or the end of the sheets which freely depends from the table may abut against the projecting part of the roller to be folded thereby. The underside of the sheets is not visible to an operator, and hence the folded sheets may be left uncorrected, thus causing a failure of a sheet feeding. The fact that the feed roller partly projects above the sheet receiving surface implies that there is a gap left between the sheets and the surface. Hence, when the vacuum means attracts the lowermost one of the sheets, the air may find its way through the gap, thus diminishing the attraction applied to the sheet. This results in an insufficient magnitude of the force of friction acting between the feed roller and the sheet. The purpose of applying the attraction by the vacuum means is to produce a force of friction acting between the feed roller and the sheet which is of a sufficient magnitude to convey a single sheet into the nip between the separating roller and the brake member, which are disposed in abutment against each other. If the force of friction has a reduced magnitude, a satisfactory sheet conveying cannot be assured. To provide a sufficient force of friction, the attraction applied by the vacuum means may be increased in magnitude. However, when sheets having a reduced rigidity are used, the attraction acting between the sheet receiving table and the sheet may exceed the force of friction, resulting in a failure to convey a sheet.

It is to be recognized that the sheets disposed in a stack do not always maintain their planarity, but frequently exhibit departures therefrom such as wrinkles, waviness, upward or downward warp. Hence, when the sheets are directly disposed in a stack without previously correcting their departure from the planarity, it is a rare occurrence that the leading ends of the sheets be disposed in the nip between the separating roller and the brake member in a sequentially staggered from or in alignment. Rather, the stresses in the sheets or the rigidity of the sheets may prevent the leading end of the sheet from reaching the nip to cause a failure to feed a sheet, or if the sheet is fed, the leading end of the sheet may be folded or damaged. Such difficulties occur independently from the orientation of the sheet receiving table.

Above difficulties can be elminated if an operator corrects for poor planarity of the sheets before the latter are placed on the table. However, the usual practice is often as simple as turning a folded edge back. Thus, it must be realized that the leading end of the sheets is seldom disposed in a separating station while maintaining an ideal planar condition, but that in practice, the sheets are fed under a condition which is often astable enough to cause an overlap feed or the failure to feed a sheet.

It should be noted that the materials for the separating roller and the brake member are chosen and their surface treatment made to provide a relationship given below, $$\mu 2 > \mu 3 > \mu 1$$

where $\mu 1$ represents the coefficient of friction between sheets, $\mu 2$ between the separating roller and sheet and $\mu 3$ between the brake member and sheet.

What is contemplated by such relationship is to assure that only the lowermost one of the sheets be fed as a result of the force of friction ($\mu 2$) acting between the separating roller and the sheet exceed in magnitude the force of friction ($\mu 3$) acting between the brake member and the sheet. If the above inequality is satisfied, the magnitude of the coefficient $\mu 2$ is not much greater than that of the coefficients $\mu 3$ and $\mu 1$, but the inequality is maintained by a small difference among these magnitudes. When a sheet to be fed is high quality paper, the magnitude of $\mu 3$ is on the order of 0.8 to 0.9 and the magnitude of $\mu 1$ is on the order of 0.5 to 0.7 as referenced to the magnitude unity of $\mu 2$. Consequently, when the separating roller feeds a sheet by utilizing the force of friction ($\mu 2$), the force of friction ($\mu 3$) acting between the brake member and the sheet represents a loading on the separating roller which causes the sheet to be braked as it is being conveyed by the feed roller, causing a slip to occur between the separating roller and the sheet. In other words, the speed of the sheet being fed by the feed roller is different from the speed of the sheet. as the latter passes through the separating station. By way of example, in a facsimile system, originals to be transmitted comprise sheets having varying properties, and the speed of the sheet in the separating station is slower than the speed of the sheet being fed by the feed roller by an amount on the order of 20% to 30%. Since the sheet is being conveyed by the feed roller while its leading end is braked, it is possible that in worst cases, the leading end of the sheet may be folded, skewed or the image may be subjected to a rubbing action. When the feed roller is separately provided, a conventional design is that the feed roller functions to convey a length of sheet which is approximately equal to one circumference length of the roller. In other words, the design is such that one revolution of the feed roller is sufficient to convey the leading end of the sheet into the nip between conveying rollers which are disposed downstream, as viewed in the sheet feed direction. However, when the leading end of the sheet is braked in the manner mentioned above, the transmission of the drive to the feed roller is interrupted before the leading end of the sheet reaches the nip between the conveying rollers, In the event of such occurrence, the sheet must be conveyed by the separating roller, causing the failure to feed or a damage of the image as by rubbing action.

As a matter of practice, sheets having a variety of surface characteristics are used as originals which are to be transmitted in a facsimile system or to be copied in a copying machine. As a result, during a sheet feeding operation, an elastic material contained in the brake member may be subject to an oscillation as it slips depending on the variety of the sheets. Such oscillation of the elastic material may be transmitted through its support to other members. In particular, a strip-shaped member may be caused to vibrate in the manner of resonance, thus producing an uncomfortable sound. This phenomenon is attributable to the fact that the brake member is fixedly mounted. In addition to causing the sound, the fixing of the brake member may cause a biased abrasion of the elastic blade or a skewing of sheets depending on the manufacturing or assembly tolerances of parts in the separation unit.

SUMMARY OF THE INVENTION

The invention contemplates the provision of an automatic sheet feeding apparatus which eliminates the described difficulties or drawbacks of the prior art.

Specifically, it is a first object of the invention to provide an automatic sheet feeding apparatus which is simple in construction and easy to use while allowing a manual feed of even those sheets which contain wrinkles or curls or which have other material applied thereto.

This object of the invention is achieved by an automatic sheet feeding apparatus which comprises a table on which sheets are placed in a stack, a separating roller disposed adjacent the free end of the table and having its peripheral surface partly projecting above the sheet receiving surface of the table, drive means for driving the separating roller for rotation in a sheet feed direction, brake means including a brake member which is disposed in abutment against the peripheral surface of the separating roller, and a separation unit which is selectively located to enable an automatic feed mode in which the brake member is disposed in abutment against the separating roller and a manual feed mode in which the brake member is moved away from the separating roller to define a manual feed path.

In accordance with the invention, the brake member is carried by the separation unit which is disposed to be movable toward or away from the table. Hence, by merely bringing the unit to its manual feed position, the brake member is located away from the separating roller to define the manual feed path, allowing any sheet which contains wrinkles or another material applied thereto to be fed. Obviously, any wrinkle or curl which can be corrected should be removed before the feeding operation. A sheet which cannot be subjected to a feeding operation, standing along, may be held between a pair of carrier sheets.

It is a second object of the invention to provide an automatic feeding apparatus which is arranged to prevent any unnecessary bias or force from being applied to the brake member.

This object of the invention is achieved by an automatic sheet feeding apparatus including a sheet delivery guide disposed downstream of the separating roller, as viewed in the sheet feed direction, in substantially parallel relationship with a tangential line between the abutting separating roller and brake member.

In accordance with the invention, a separated sheet is conveyed in the direction of tangential between the brake member and the separating roller, whereby the likelihood is avoided that the sheet causes the brake member to move in a direction away from the separating roller to cause a reduction in the pressure of contact therebetween. In this manner, an immediately adjacent sheet is prevented from following the lowermost sheet, assuring a reliable separation.

It is a third object of the invention to provide an automatic sheet feeding apparatus capable of providing an indication of the limit on the height of the stack of sheets, without using a special member.

This object of the invention is achieved by an automatic sheet feeding apparatus in which the separating unit also serves as a level member which indicates and controls the limit on the height of the stack of sheets placed on the table.

In accordance with the invention, the use of the separation unit to restrict the height of the stack of sheets dispenses with any special member or special indicium. If it is attempted to dispose more sheets in the stack in excess of the limit of the height defined by the separation unit, such sheets cannot be disposed on the table, thus effectively avoiding any failure of a sheet feeding.

It is a fourth object of the invention to provide an automatic sheet feeding apparatus including a cross sheet guide mechanism which can be easily operated and which is assured against an unintended movement in response to oscillations.

This object of the invention is achieved by an automatic sheet feeding apparatus including a cross sheet guide mechanism which comprises a pair of cross sheet guides forming part of the sheet receiving surface of the table on which sheets are placed in a stack and functioning to guide the opposite lateral edges of the sheets, a guide shaft for supporting the cross guides so as to be movable in a direction perpendicular to the sheet feed direction, connecting means for simultaneously moving the pair of sheet guides in opposite direction with respect to each other, a click stop positioning mechanism for positioning the cross sheet guides at a plurality of positions on the shaft which correspond to different sizes of sheets, and a release mechanism on at least one of the cross sheet guides for releasing the click stop action of the positioning mechanism.

In accordance with the invention, the pair of cross-sheet guides are disposed to be movable in opposite directions with respect to each other and are held at a position which corresponds to the sheet size by a click stop action. This facilitates operating the cross sheet guides and also avoids a displacement of the cross sheet guides in response to oscillations, thus assuring the sheets placed in the stack to be guided in a stable attitude. This allows the sheet feed means to feed the sheets, one by one, without involving a skew or jamming.

It is a fifth object of the invention to provide an automatic sheet feeding apparatus which avoids a folding of the leading end of the sheets as they are placed in a stack on the table and in which a suction of a given magnitude, applied to the sheet, is maintained independently from the variety of sheets.

This object of the invention is achieved by an automatic sheet feeding apparatus including a feed roller disposed upstream of the separating roller, as viewed in the sheet feed direction, and driven for rotation in the sheet feed direction, the feed roller having its peripheral surface partly removed to provide a hiatus area which is located flush with or below the sheet receiving surface of the table when the feed roller is not driven for rotation.

In accordance with the invention, the peripheral surface of the feed roller is partly notched or removed to provide a hiatus area which is located flush with or below the sheet receiving surface of the table when the roller is not rotating. In other words, the hiatus area does not project above the sheet receiving surface, so that if the leading end of the sheet is curled downwardly when they are to be placed on the table, they cannot be folded back by abutment against the roller. In this manner, the failure to feed or or an overlap feed which might occur as a result of the leading end of the sheets being folded back is avoided.

The fact that the feed roller does not project above the sheet receiving surface also means that no clearance is formed between the sheet receiving table and the sheet as the latter is placed thereon. Accordingly, when the vacuum means is activated at the initiation of a feeding operation, there occurs no no leakage of air, allowing the sheets to be positively attracted to the sheet receiving surface irrespective of the rigidity thickness or weight of various sheets. In this manner, the sheets are subject to a conveying force or a frictional force applied by the rotating feed roller.

This means that the sheets of any kind can be moved into the nip between the separating roller and the brake member, with a positive conveying force.

It is a sixth object of the invention to provide an automatic sheet feeding apparatus capable of properly feeding sheets containing a poor planarity condition such as down or up curl or waviness, by applying an automatic correction of the sheet planarity and without causing an overlap feed or the failure to feed.

This object of the invention is achieved by an automatic sheet feeding apparatus including a sheet retaining member located upstream of the brake member and downstream of the feed roller as viewed in the sheet feed direction and movable in a direction toward or away from the sheet receiving table.

The provision of the sheet retaining member causes any curl in the sheets, which are placed in a stack on the table, to be corrected so that the sheets are properly fed into the nip between the separating roller and the brake member, as guided by the sheet retaining member. In other words, sheets exhibiting a poor planarity can be properly guided into the separating station as a result of the guiding action of the sheet retaining member, thus avoiding an overlap feed or the failure to feed.

The sheet retaining member may include a guide which assumes an inclined position so that its forward end, as viewed in the sheet feed direction, is at the lowest point to allow the leading end of a lower sheet in the stack to precede the upper sheets, and a keeper which holds the sheets against the separating roller. When such an arrangement is employed, it is assured that when sheets are placed on the table, lower sheets have their leading end located forwardly of the leading end of the upper sheets, thus allowing the sheet to be fed in proper manner beginning with the lowermost one and advantageously increasing the force of friction acting between the separating roller and the sheets.

Additionally, a sheet stop may be provided which is located upstream of the brake member as viewed in the sheet feed direction and spaced from the peripheral surface of the separating roller by a small gap, the stop being disposed for abutment by the leading end of sheets in the stack so that the leading end of a lower sheet is located forwardly of the leading end of an upper sheet. The stop cooperates with the sheet retaining member to restrict the number of sheets which are permitted to move into the nip between the separating roller and the brake member while allowing the leading end of a lower sheet to be located forwardly of the leading end of an upper sheet. In this manner, sheets can be separated reliably and in a proper sequence.

It is a seventh object of the invention to provide an automatic sheet feeding apparatus capable of providing a stable sheet feeding operation, avoiding a retardation of a sheet in the separating station if the sheet being fed is braked.

This object of the invention is achieved by an automatic sheet feeding apparatus in which the number of revolutions of the separating roller is established at a value higher than the number of revolutions of the feed roller by an amount which is sufficient to compensate for a delay of the sheet feed caused by a slippage of the sheet between the separating roller and the sheet.

In accordance with the invention, when the number of revolutions for the separating roller is established at a level higher than that of the feed roller, any delay or lag in the sheet feeding operation which might occur as a result of the leading end of the sheet being braked by the brake member to cause a slip between the separating roller and the sheet can be immediately compensated for by the differential numbers of revolutions. This prevents the sheet from being scored or skewing, hence assuring a stable sheet feed operation. If the sheet is braked to retard its forward movement, such retardation is compensated for by the difference in the number of revolutions. Accordingly, the length of sheet fed during one revolution of the feed roller can be made equal to the effective feed length of the feed roller, assuring a relaiable delivery of the sheet into the subsequent conveying rollers.

It is an eighth object of the invention to provide an automatic sheet feeding apparatus which prevents uncomfortable sounds, attributable to oscillations of brake means, or a biased abrasion of a resilient blade or a sheet skewing from occurring.

This object of the invention is achieved by an automatic sheet feeding apparatus in which the brake member is rockably disposed rather than being secured to its upport plate.

In accordance with the invention, the brake member is rockably disposed, and hence any oscillation of the brake member which might occur during a sheet feeding operation cannot be directly transmitted to other members, avoiding the occurrence of offensive sounds of oscillations. The fact that the brake member is pivotally mounted while allowing a degree of rattling accommodates for tolerances in the manufacturing and assembly of parts of the brake member, allowing the brake member to abut against the separating roller with a uniform pressure to thereby eliminate a biased abrasion of the brake member or a sheet skewing.

DESCRIPTION OF EMBODIMENTS

Figure 1:
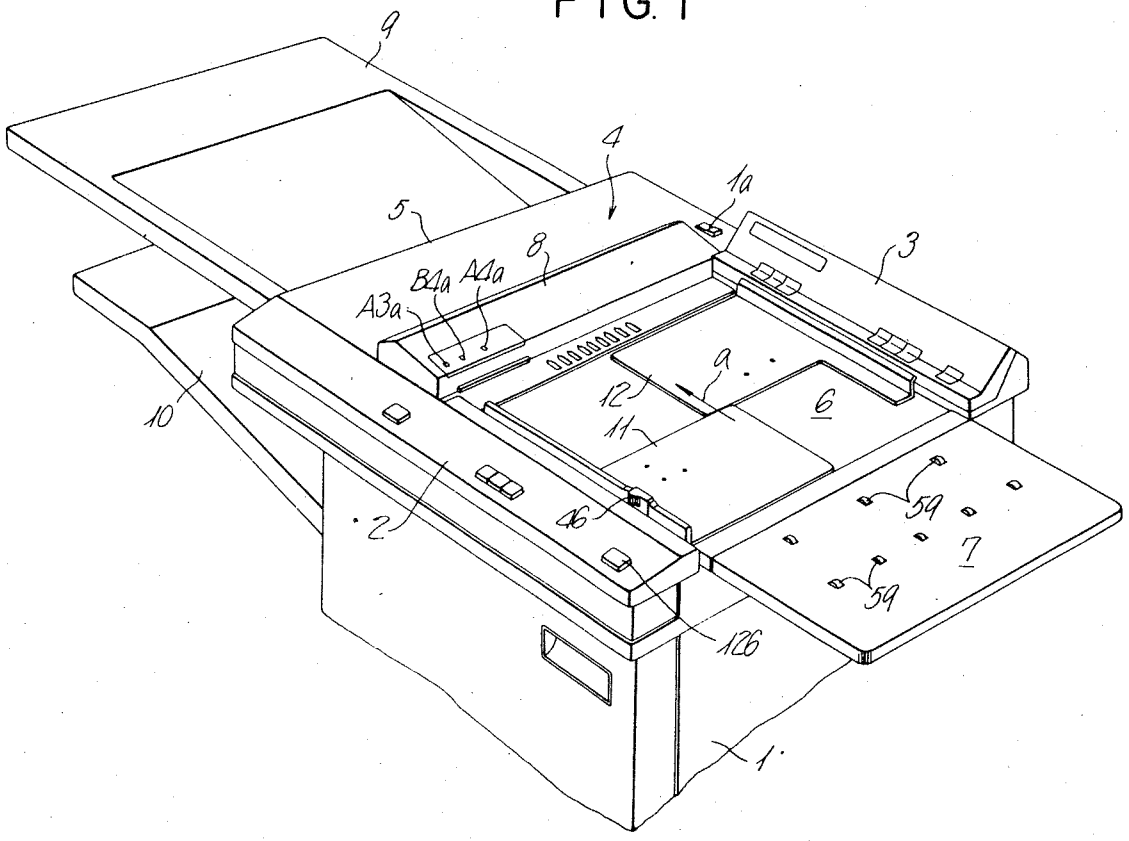
FIG. 1 is a perspective view of an exemplary facsimile system to which the invention is applied.

Referring to FIG. 1, there are shown essential parts of a facsimile system which is adapted to incorporate the present invention, in a perspective view. The system includes a body 1 carrying, on its top, a main switch 1*a*, a first control panel 2, a second control panel 3, an automatic sheet feeding apparatus 4 and a reader 5. While the automatic sheet feeding apparatus 4 will be described later in more detail, it includes a sheet receiving table 6, an auxiliary table 7 and a separation unit 8, all of which are utilized to feed a sheet or an original to be transmitted, in a direction indicated by an arrow a toward the reader 5. The original is delivered to an original stacking tray 9 after it has been read. A receiving copy tray 10 is located below the original stacking tray 9. A pair of cross sheet guides 11, 12 are mounted on the table 6 for guiding the lateral edges of the sheets.

Figure 2:
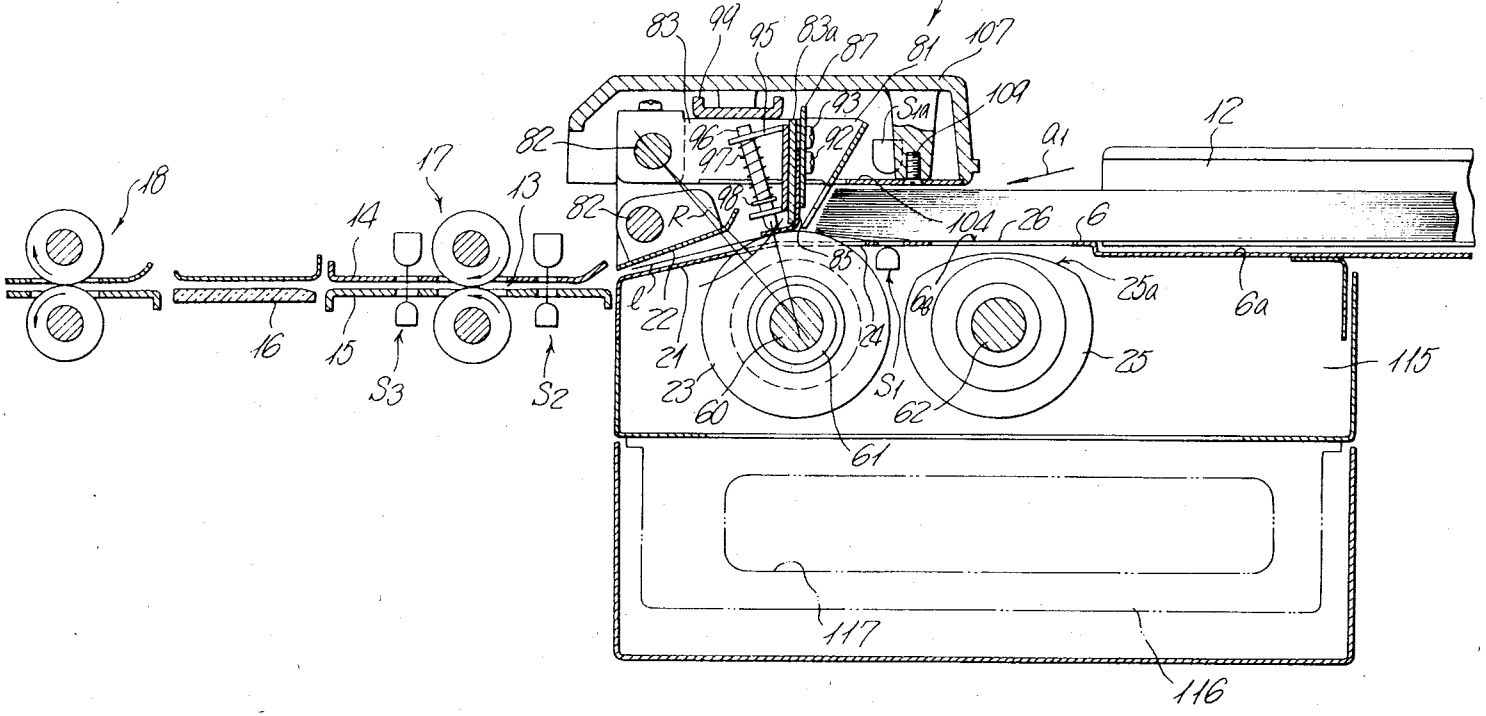
FIG. 2 is a vertical section of essential parts of an automatic sheet feeding apparatus according to the present invention.

As shown in FIG. 2, the reader 5 comprises a pair of sheet guides 14, 15 which define a sheet passage 13 therebetween, a target glass 16, a first scanner roller pair 17, a second scanner roller pair 18, a second sheet detector $S_2$ and a third sheet detector $S_3$. The first and the second scanner roller pairs 17, 18 are driven for stepwise rotation by a stepping motor, not shown. Each of the roller pairs 17, 18 begins to rotate in response to a signal from the second sheet detector $S_2$ which indicates the detection of the leading end of a sheet, and feeds the sheet toward or past the target glass 16. At a given time interval after the detection of the leading end of the sheet by the third sheet detector $S_3$, which time interval corresponds to the time required for the leading end of the sheet to reach the target glass, both of the roller pairs 17, 18 are stopped momentarily, and resume rotation to feed the sheet again when the facsimile system at the receiving end is ready to receive the transmission. Reader assembly (not shown) including a light source for illuminating the original is disposed below the target glass 16.

Figure 3:
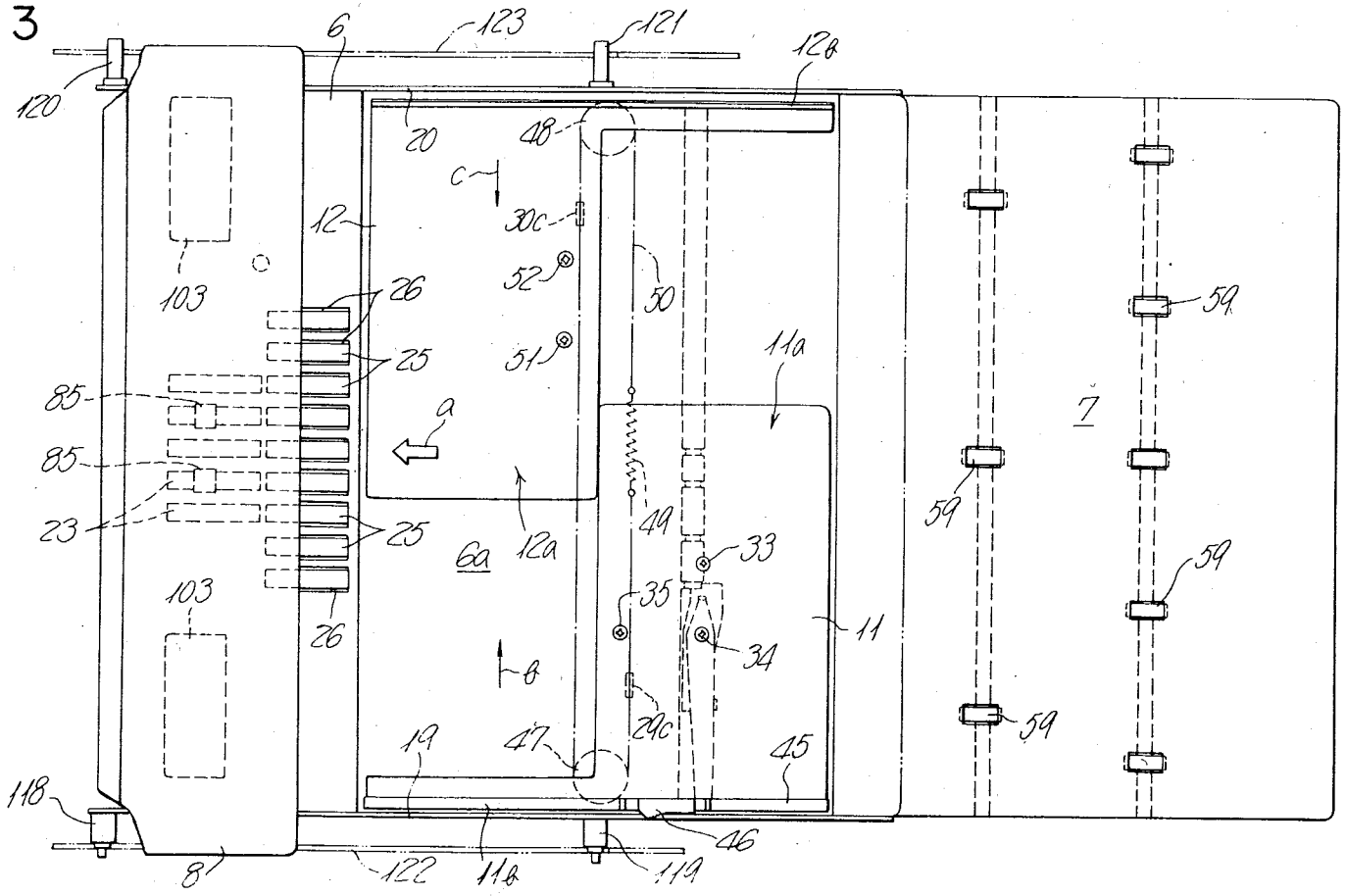
FIG. 3 is a plan view of the automatic sheet feeding apparatus.
Figure 4:
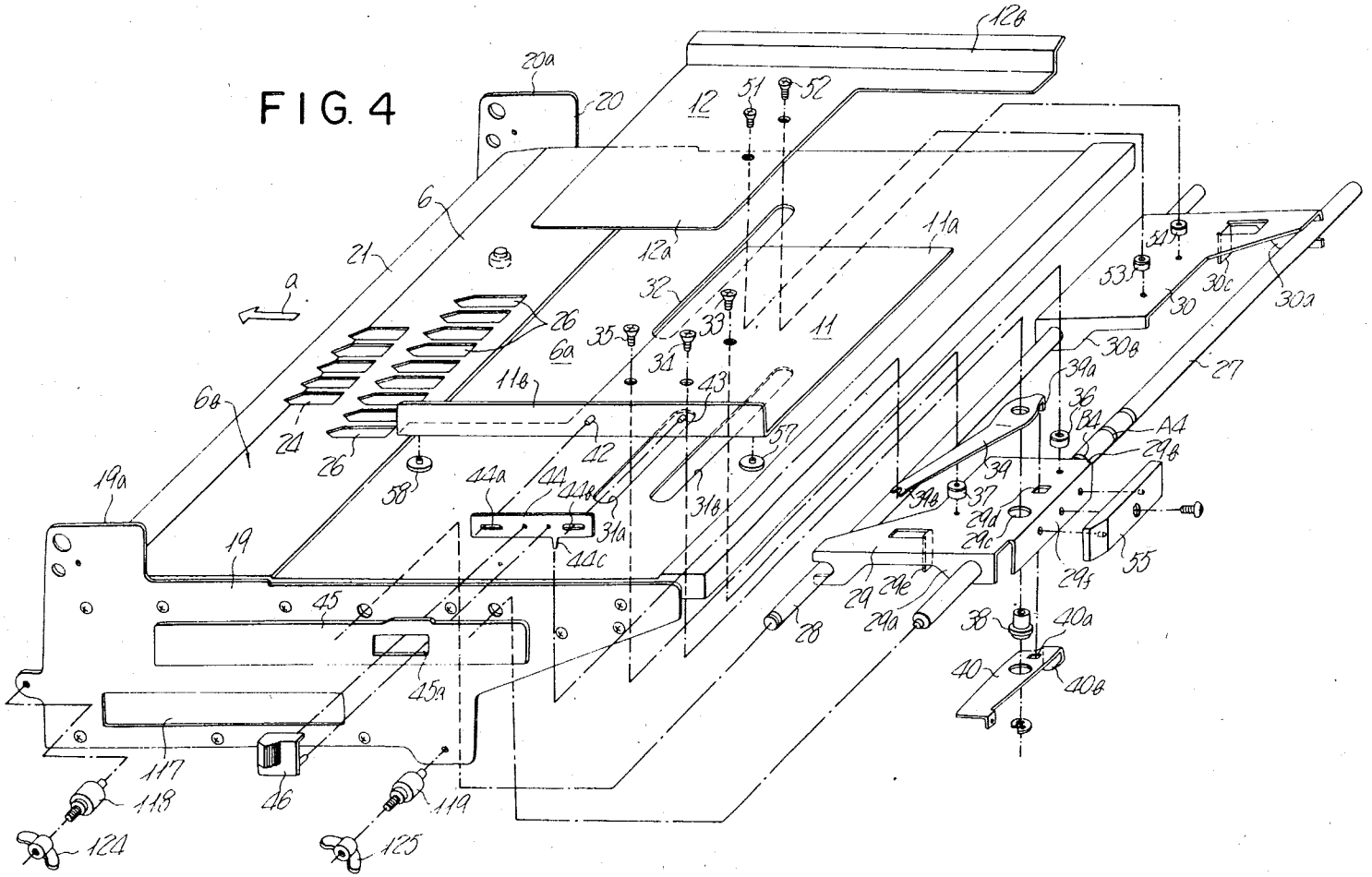
FIGS. 4 and 5 are exploded, perspective views of the apparatus.

The construction of the automatic sheet feeding apparatus 4 will be described with reference to FIGS. 2 to 5. As shown in FIGS. 3 and 4, the table 6 is substantially integrally secured to a pair of side plates 19, 20 of the apparatus, thus forming part of the frame of the apparatus. The forward edge of the table 6 is defined by a lower sheet delivery guide 21 which is bent to extend downwardly. An upper sheet delivery guide 22 (FIG. 5) is located above the lower guide 21 and is secured to the side plates 19, 20. In this manner, both guides 21, 22 define a sheet delivery guide assembly. The sheet delivery guide assembly functions to guide a sheet, which has been separated in the separating station to be described later, into the reader, and forms part of the sheet passage 13. It is to be noted that the lower guide 21 is disposed substantially parallel to the tangential line l (FIG. 2) between the separating roller and the brake member, both to be described later.

Formed in the forward end portion of the table 6 are slots 24 through which the peripheral surface of the separating roller 23 projects, and also slots 26 through which the peripheral surface of the feed roller 25 partly projects. Each of these slots 24 and 26 has a tapered downstream edge as can be seen in FIG. 4. The table 6 includes a central region 6*a* which is at a lower elevation as compared with the level of the front and the rear portion of the table.

Slidably disposed on the central region 6*a* of the table are the cross sheet guides 11, 12, which are movable in a direction perpendicular to the sheet feed direction. Both of the sheet guides include sheet receiving portions 11*a*, 12*a* which are complementary in configuration to each other and which are disposed in a plane flush with the front and the rear portion of the table 6, and also include upstanding portions 11*b*, 12*b* which are adapted to guide the lateral edges of sheets.

As shown in FIG. 4, disposed below the table 6 are a pair of parallel guide shafts 27, 28, which are secured to and supported by the side plates 19, 20. The guides shafts 27, 28 carry slide plates 29, 30, respectively, in an axially slidable manner, these slide plates carrying the cross sheet guides. The slide plate 29 includes a pair of oppositely located, downwardly depending portions 29*a*, 29*b* which are bent down from the plane of the main body thereof. The depending portions 29*a*, 29*b* are formed with aligned openings, through which the guide shaft 27 extends. The depending portion 29*a* is formed with a notch which is engaged with the other guide shaft 28. In this manner, the slide plate 29 is movable axially of the guide shaft 27 and in a plane which is parallel with the table 6 while maintaining a horizontal position. Similarly, the slide plate 30 includes a pair of oppositely located, depending portions 30*a*, 30*b* which are bent down from the plane of the main body thereof and formed with openings through which the guide shaft 28 extends. The depending portion 30*a* is formed with a notch which is engaged with the guide shaft 27, whereby the slide plate 30 is movable axially of the guide shaft 28 in a horizontal plane parallel with the table 6.

It will be noted that the central region 6*a* of the table 6 is formed with a pair of elongate slots 31*a*, 31*b* which extend parallel to the guide shafts 27, 28, respectively. The cross sheet guide 11 is secured to the slide plate 29 by a pair of screws 33, 34 extending through the slot 31*b* and by a screw 35 which extends through the slot 31*a*. It will be noted that the screws 33, 35 are threadably engaged with corresponding threaded bores in the slide plate 29 with spacers 36, 37 interposed therebetween. The screw 34 threadably engages a threaded bore formed in a stub shaft 38 which fits in an opening 29*c* formed in the slide plate 29. In this manner, the cross sheet guide 11 is substantially integral with the slide plate 29.

Figure 11:
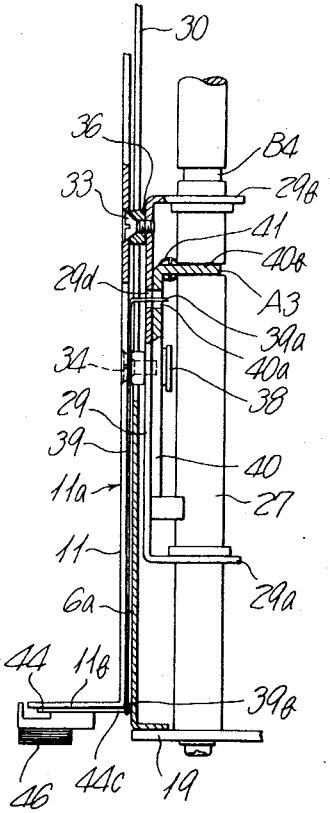
FIG. 11 is a side elevation of the mechanism.
Figure 9:
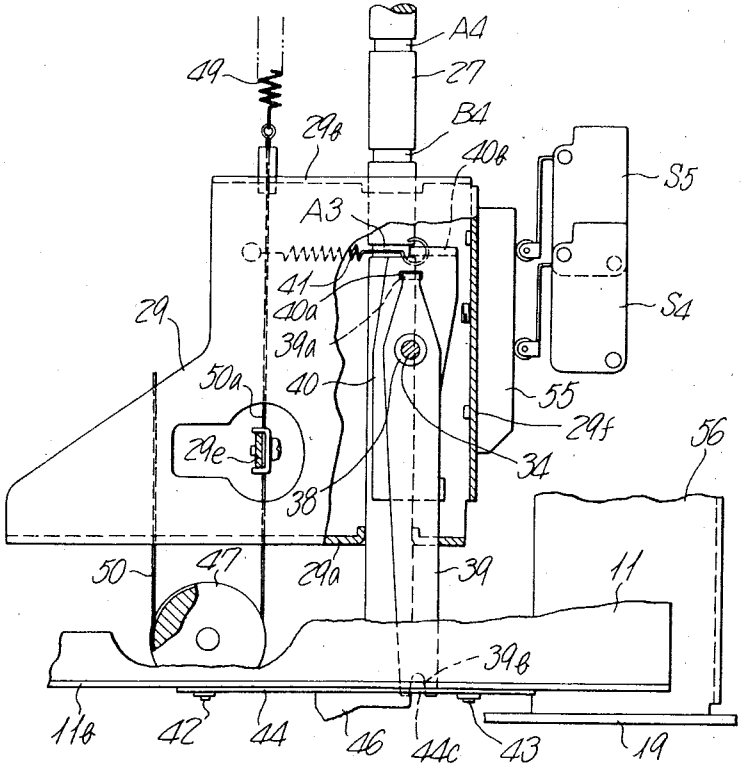
FIG. 9 is a plan view of essential parts of a cross sheet guide mechanism.
Figure 10:
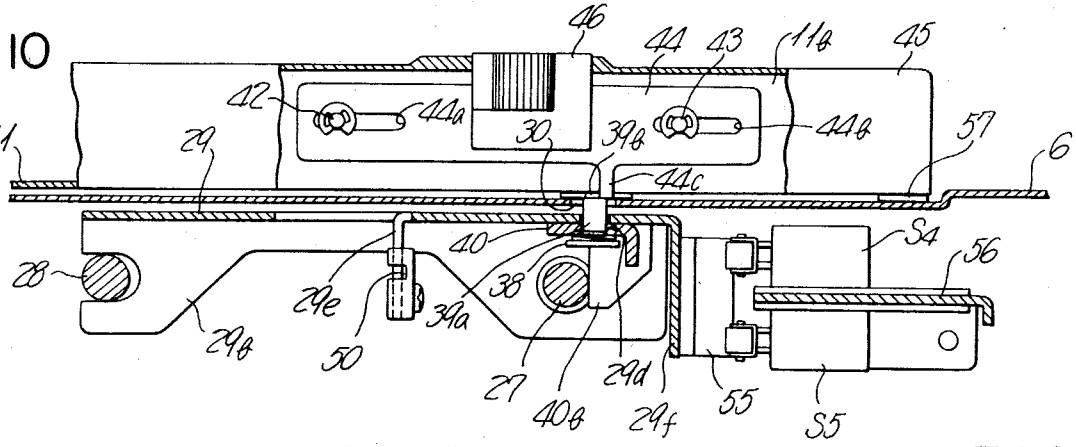
FIG. 10 is a cross section of the mechanism.

The stub shaft 38 projects above the slide plate 29 to an elevation which is level with the spacers 36, 37, and an oscillating member 39 formed by a leaf spring is pivotally mounted on the projecting end of the stub shaft. The oscillating member 39 includes one end 39*a* which is bent downwardly to extend through a slot 29*d* formed in the slide plate 29 (FIGS. 4, 10 and 11). A positioning member 40 is pivotally mounted on a portion of the stub shaft 38 which extends below the slide plate 29. The positioning member has a slot 40*a* formed therein which is engaged by the end 39*a* of the oscillating member 39, and is also formed with a positioning claw 40*b* which depends downwardly. As shown in FIG. 9, the positioning member 40 is urged by a spring 41, extending between it and a pin fixedly mounted on the underside of the slide plate 29, in a direction to bring the claw 40*b* into abutment against the guide shaft 27. The guide shaft 27 is formed with peripheral grooves A3, B4, A4 (FIGS. 4, 9 and 11) for positioning purpose which are selectively engaged by the positioning claw 40*b*. The purpose of these peripheral grooves are to hold the cross sheet guides 11, 12, by a click stop action, at locations where they are able to guide both lateral edges of sheets cut to standard sizes. Specifically, the peripheral groove A3 is utilized to feed an A3 size sheet lengthwise or an A4 size sheet crosswise; the peripheral groove B4 is used when feeding a B4 size sheet lengthwise or a B5 size sheet crosswise; and the peripheral groove A4 is used when feeding an A4 size sheet lengthwise or an A5 size sheet crosswise, each time providing a click stop action upon the cross sheet guides 11, 12.

As shown in FIG. 9, the other end of the rockable member 39 extends to a point below the upstanding portion 11*b* of the cross sheet guide 11, there being formed an engaging portion 39*b*. As shown in FIGS. 4, 9 and 10, the upstanding portion 11*b* fixedly carries guide pins 42, 43, which are loosely fitted into elongate slots 44*a*, 44*b* formed in a slide plate 44, thus allowing the latter to be slidable to an extent permitted by the length of the elongate slots. The lower edge of the slide plate 44 is formed with a tab 44*c* which is adapted to engage the engaging portion 39*b* of the rockable member 39. A cover 45 is secured to the upstanding portion 11*b* for covering the slide plate 44. It is to be noted that the cover 45 is not shown in FIGS. 9 and 11. The cover 45 is formed with a window slot 45*a* through which extends a release knob 46 which is secured to the slide plate 44. As viewed in FIGS. 1 to 9, the cross sheet guides 11, 12 are located in positions in which they operate to guide sheets of the A3 size. At this time, the positioning claw 40*b* is engaged with the peripheral groove A3 under the resilience of the spring 41. The spring 41 acts through the rockable member 39 to urge the slide plate 44 to a position where the guide pins 42, 43 are located at the left-hand end, as viewed in FIG. 9, of the elongate slots 44*a*, 44*b*.

Figures 5, 22:
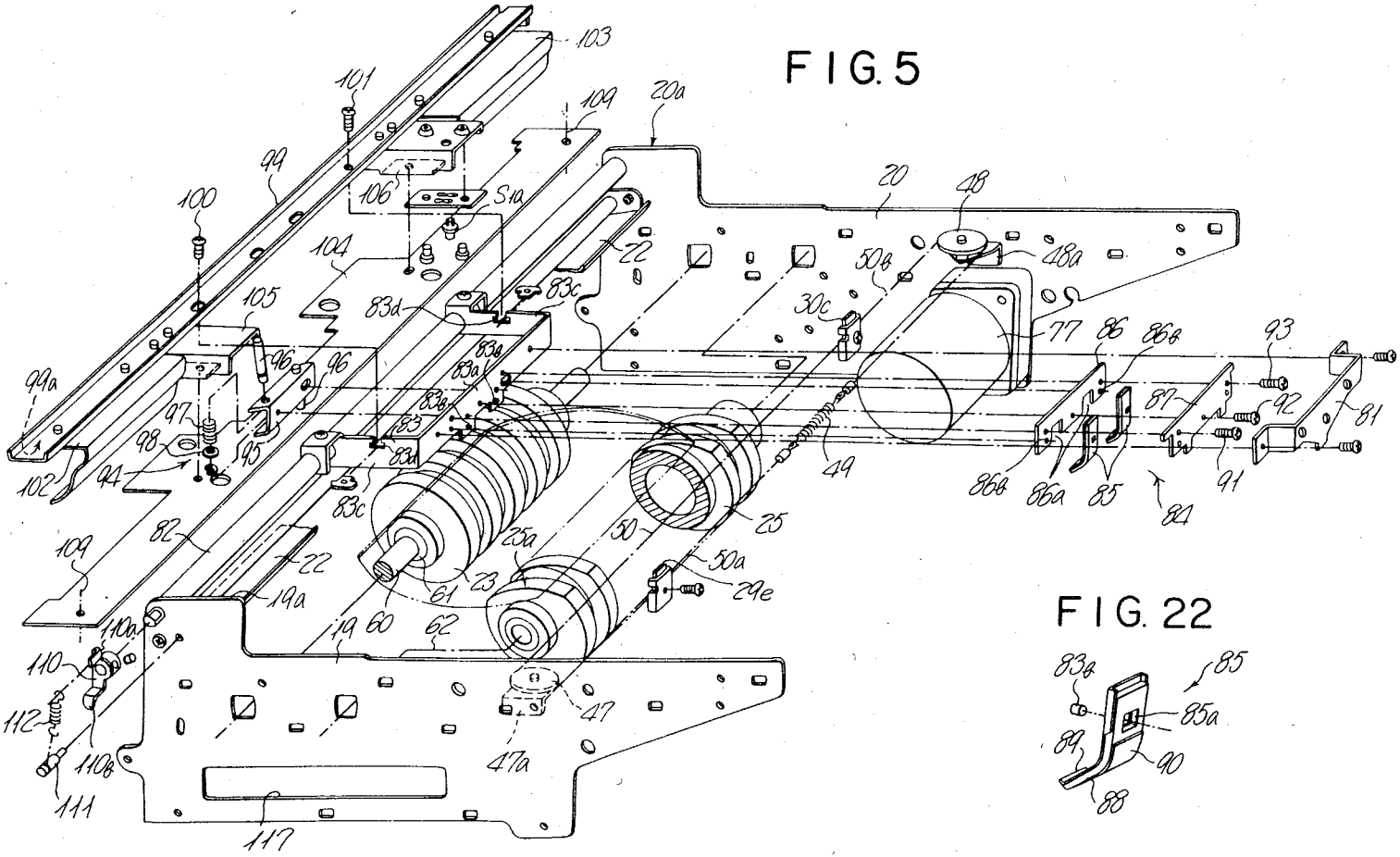
FIGS. 21 and 22 are perspective views showing other forms of the brake member.

Referring to FIG. 5, a pair of pulleys 47, 48 are pivotally mounted on the side plates 19, 20, respectively, by utilizing brackets 47*a*, 48*a*, and a wire 50 which is substantially endless extends across the pulleys and is tensioned by a tension spring 49. On the other hand, as shown in FIG. 4, the slide plates 29, 30 are formed with wire anchorages 29*e*, 30*c*, respectively, which are cut from the main body of the slide plates. One run 50*a* of the wire 50 is anchored to the anchorage 29*e* while the other run 50*b* is anchored to the anchorage 30*c*.

The slide plate 30 is secured to the cross sheet guide 12 by utilizing screws 51, 52 and spacers 53, 54 which are loosely fitted in an elongate slot 32. Since both cross sheet guides 11, 12 are connected together through the wire 50, when the click stop action by the positioning member 40 is released in a manner to be described later, a movement of one of the cross sheet guides, 11, in a direction indicated by an arrow b shown in FIG. 3 causes the other cross sheet guide 12 to move through a same distance in a direction indicated by an arrow c.

The slide plate 29 includes a lateral side 29*f* which is bent down from the body thereof, and which fixedly carries a cam 55 for detecting the position of the cross sheet guide, as shown in FIGS. 4, 9 and 10. Referring to FIGS. 9 and 10, a switch support plate 56 extends between and is supported by the side plates 19, 20, and fixedly carries switches $S_4$, $S_5$ on its upper and lower surfaces, respectively. Actuators associated with these switches are located in a path of movement of the cam 55, so that when the switches $S_4$, $S_5$ are actuated, there is produced an indication that the cross sheet guides 11, 12 are positioned so as to guide sheets of the A3 size, as shown in FIG. 9. Such detection signal is transmitted to the receiving end as a signal which indicates that an original of the A3 size is to be transmitted. The receiving end responds thereto by selecting a record sheet which is suitable for the reception of such transmission. When the receiving end is prepared with a record sheet of the A3 size set in position, a signal is fed back to the transmitting end indicating that the receiving end is ready to receive the transmission, thus causing a lamp A3*a* in the separation unit 8 (FIG. 1) to be illuminated. It is to be understood that the lamp A3*a* also represents an index indicating one lateral edge of sheets of the A3 size which are placed on the table.

In the event the facsimile system has the capability of providing a magnification less than unity, the transmission between the transmitting and the receiving end is possible if the size of an original used in the transmitting end differs from that of a record sheet used in the receiving end. Sheets of both B4 and A4 sizes are available as record sheets in this instance and are selectively utilized.

By way of example, if a record sheet of the B4 size is loaded in the equipment of the receiving end when transmitting from an original of A3 size, the transmitting end causes the lamp A3*a* to be illuminated concurrently with an an indication "transmitting on a reduced scale" (not shown), and the picture from the original of the A3 size is recorded on the sheet (B4 size) of the receiving end on a reduced scale. In this manner, an arrangement is made to allow the transmitting end to determine automatically if the transmission should take place with a magnification of unity or a reduced magnification in accordance with a feedback signal from the receiving end which indicates the size of the record sheet loaded therein if the sheet sizes disagree.

The cross sheet guides 11, 12 are moved selectively to a position which corresponds to the B4 or A4 size, whereupon the switch $S_4$ is turned off and the switch $S_5$ is turned on, or both switches $S_4$ and $S_5$ are turned off, sending a signal to the receiving end which indicates that an original of the B4 or A4 size is to be scanned.

Referring to FIG. 4, spacers 57, 58 formed of a cork material are secured to the underside of the cross sheet guide 11. Since the rockable member 39 is interposed between the cross sheet guide 11 and the central region 6*a* of the table, the spacers 36, 37 form a clearance therebetween so that the member 39 can be placed therein. The purpose of the spacers 57, 58 is to prevent the cross sheet guide 11 from being deformed in response to depression thereof by the operator as when the sheets are placed on the table. It is to be noted that the sheet receiving portions 11*a*, 12*a* of the cross sheet guides 11, 12 which are located above the central region 6*a* of the table are situated in a plane common with the sheet receiving surface of the table 6 other than the central region 6*a* thereof.

The auxiliary table 7 shown in FIGS. 1 and 3, but not shown in FIG. 4, is provided to accommodate for a sheet of a larger size, or a sheet of the A3 size, for example, which would be fed lengthwise, since the lagging one-half of the sheet may extend beyond the rear end of the table 6. A plurality of sheet feed rollers 59 are provided on the auxiliary table 7 and have their peripheral surfaces partly projecting above the sheet receiving surface thereof. These rollers are rotatably disposed on the auxiliary table 7 to reduce the friction acting between the sheet being conveyed and the table.

As shown in FIG. 5, the separating roller 23 is mounted on a support shaft 60 with a one-way clutch 61 interposed therebetween. The support shaft 60 extends across and is rotatably supported by the side plates 19, 20. In the example shown, the separating roller 23 actually comprises five sub-rollers which are formed of an elastic material such a sponge rubber, with part of their peripheries projecting through the openings 24 formed in the table 6, as shown in FIG. 2. In FIG. 5, the feed roller 25 is integrally supported by a support shaft 62 which is rotatably carried by the side plates 19, 20. In the example shown, the feed roller 25 comprises nine sub-rollers which are formed of an elastic material such as sponge rubber, with their peripheral surfaces being partly removed to provide a hiatus area. The rotation of the feed roller 25 is controlled in a manner to be described later, and when it does not rotate, the hiatus area 25*a* is located opposite to the opening 26 and located below the sheet receiving surface 6*b*.

Figure 6:
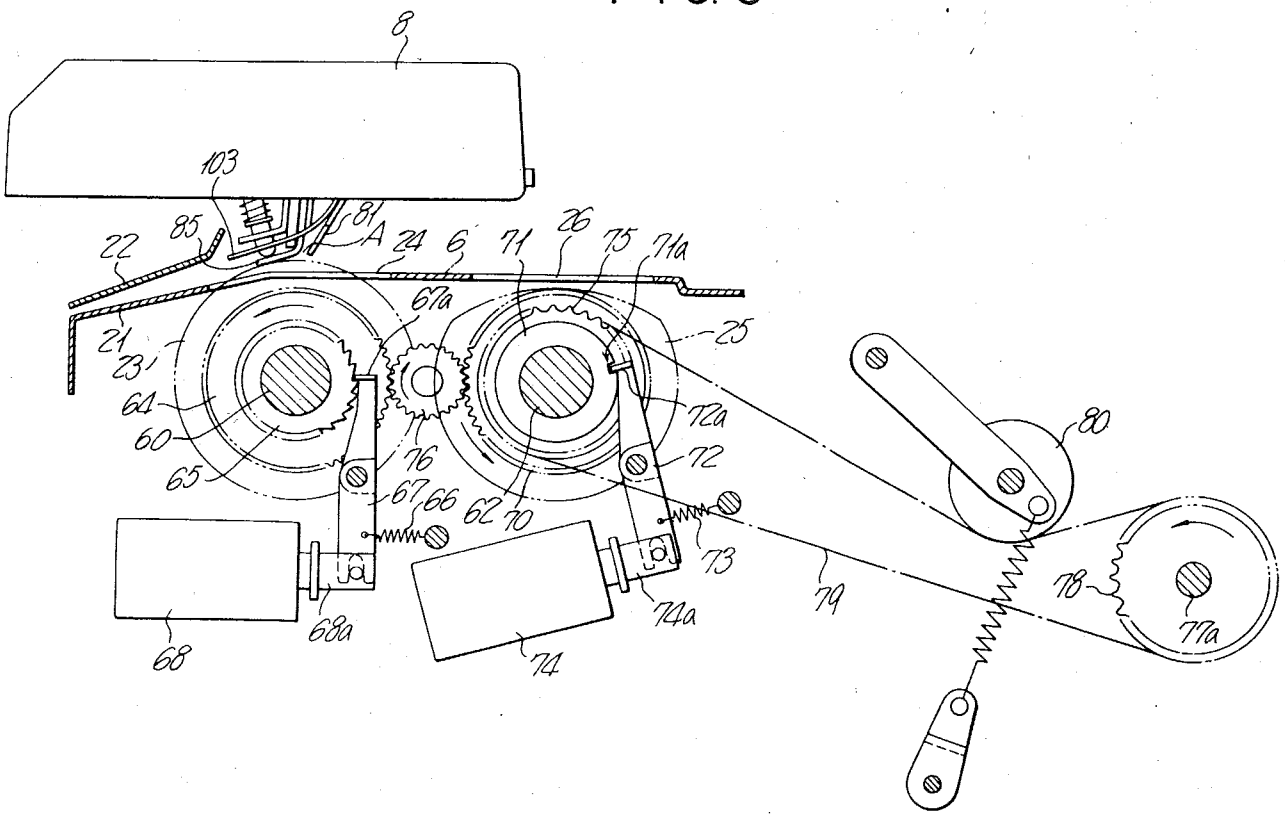
FIG. 6 is a vertical section of drive means used in the apparatus.
Figure 7:
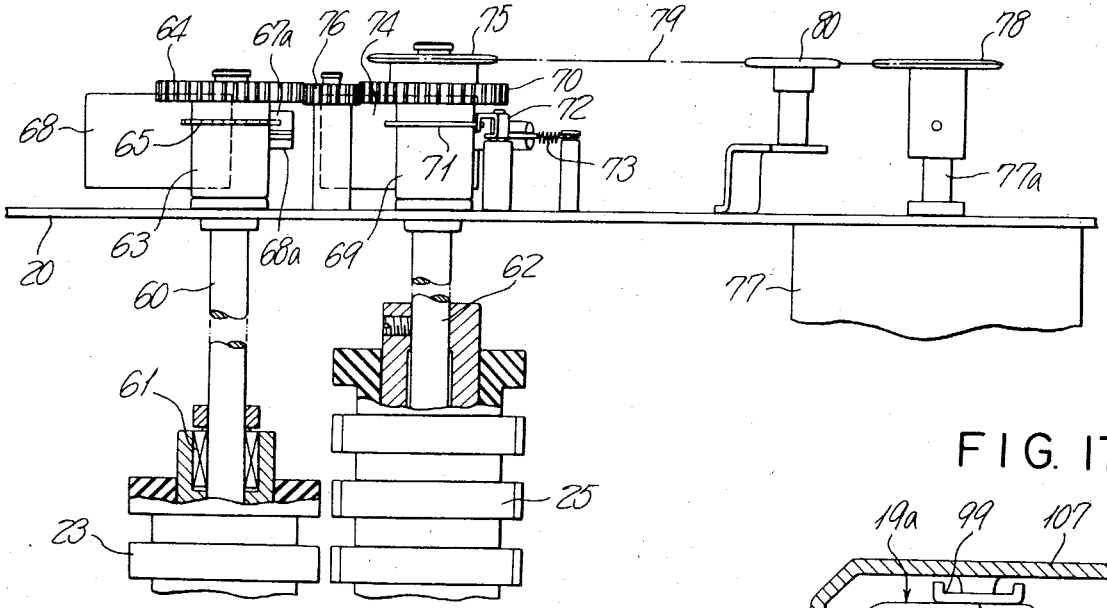
FIG. 7 is a plan view of the drive means.

Referring to FIGS. 6 and 7 for a description of drive means associated with the separating roller 23 and the feed roller 25, a gear 64 is mounted on the end of the support shaft 60 with a clutch 61 interposed therebetween. The clutch 61 includes a ratchet wheel 65, which is in turn engaged by a pawl 67*a* on a detent lever 67 which is pivotally mounted on the side plate 20 and which is urged by a spring 66 to bring the pawl 67*a* into engagement with the ratchet wheel 65. One end of the detent lever 67 is connected to an actuator rod 68*a* of a solenoid 68. The solenoid 68 is energized in response to the depression of a transmission button 126 (FIG. 1) serving as a transmission start switch, and is deenergized in response to a detection signal from the third sheet detector S3 (FIG. 2) which detects the presence of the leading end of a sheet.

On the other hand, a gear 70 is mounted on the end of the support shaft 62 carrying the feed roller 25, with a one-revolution clutch 69 interposed therebetween. The one-revolution clutch 69 includes a flange 71 in which a notch 71*a* is formed. The notch 71*a* is engaged by a pawl 72*a* on a detent lever 72 which is pivotally mounted on the side plate 20. The detent lever 72 is urged by a spring 73 so as to bring the pawl 72*a* into abutment against the peripheral surface of the flange 71. One end of the detent lever 72 is connected to an actuator rod 74*a* of a solenoid 74. A sprocket wheel 75 which is substantially integral with the gear 70 is mounted on the support shaft 62. An idle gear 76 is interposed between the gears 64 and 70.

The gears 64, 76 and 70 mesh with each other while rotating in their respective directions. The transmission gear ratio is chosen such that the number of revolutions of the support shaft 60 is about 20% higher than the number of revolutions of the support shaft 62. In other words, when the separating roller 23 and the feed roller 25 rotate simultaneously, the separating roller 23 rotates with a peripheral speed which is greater by about 20% than that of the feed roller 25.

A drive motor 77 is fixedly mounted on the side plate 20 and includes an output shaft 77*a* on which a sprocket wheel 78 is fixedly mounted. A chain 79 extends around the sprocket wheels 78 and 75, and is maintained taut by a tension wheel 80. The depression of the transmission button 126 sets the drive motor 77 in motion, whereupon the drive is transmitted through the chain 79 to rotate the gears 70, 76 and 64 in the manner shown in FIG. 6, causing them to continue rotation as long as sheets are placed on the table 6.

The rotation of the gear 70 is not transmitted to the support shaft 62 when the flange 71 is locked by the detent lever 72. However, when the flange 71 is unlocked by the energization of the solenoid 74, the support shaft 62 and hence the feed roller 75 is allowed to rotate through one revolution. Since part of the peripheral surface of the feed roller 25 is removed, the effective feed length provided by the roller corresponds to the circumference length thereof from which the peripheral length of the hiatus area is subtracted. Such length is chosen to be slightly greater than the length of the sheet path as measured from a sheet stop 81 (FIG. 2), to be described later, and the first scan roller pair 17. In the embodiment shown, the gear chain including gears 70, 77 and 64 is employed to drive the separating roller 23, but the gears 64, 70 may be replaced by sprocket wheels which are driven by a chain drive.

Figure 8:
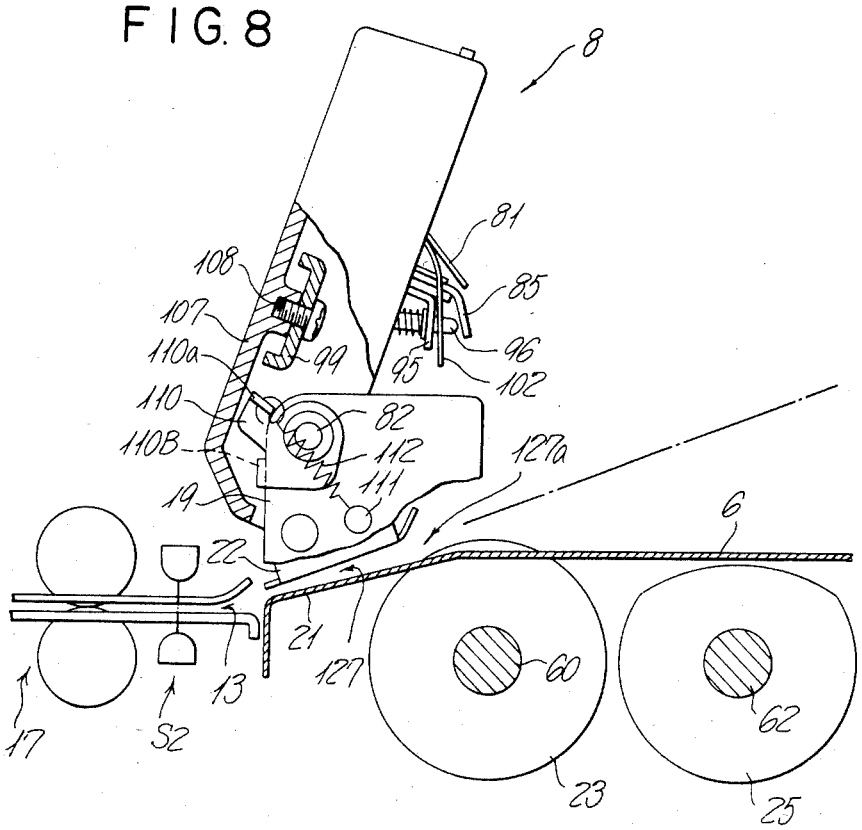
FIG. 8 is a front view illustrating a manual feed mode.

Referring to FIGS. 2, 5 and 8, the separation unit 8 will be described. FIG. 2 illustrates an automatic feed mode and FIG. 8 illustrates a manual feed mode. A support shaft 82 associated with the separation unit is rotatably journaled in the top of the side plates 19, 20 at their forward end. In the example shown, a holder 83 which is channel-shaped, as viewed in plan view, is secured to the central portion of the support shaft 82.

The holder 83 includes a front plate 83*a* extending parallel to the support shaft 82 and to which a brake assembly 84 and a sheet stop 81 are secured. The brake assembly 84 includes a spacer 86 having notches 86*a* formed therein which are engaged by brake members 85 to prevent its lateral oscillation, and a mounting plate 87 which is pressed against the brake member 85. As shown in FIG. 22, the brake member 85 comprises an elastic body 88 formed of a material such as urethane rubber and having a high coefficient of friction, a lining 89 which has resilience to cause the body 88 to flex resiliently, and a low friction member 90 applied to the curved outer portion of the elastic body and formed of a material such as Teflon (trademark), with a slot 85*a* formed in its flat portion which is utilized to prevent withdrawal. The spacer 86 has a thickness which is slightly less than that of the brake member 85. The spacer 86 is caulked to the front plate 83*a* by utilizing holes 86*b*. The brake members 85*a* are secured in place by fitting them into the notches 86*a* fromed in the spacer to cause the opening 85*a* to be engaged with projections 83*b* formed on the front plate 83*a*, followed by clamping the mounting plate 87 by means of screws 91, 92 93 extending through the front plate 83*a*. The brake members 85 are adapted to have the free end of the elastic body 88 abutting against the separating roller 23 during the automatic feed mode as shown in FIG. 2, with the curved portion of the body cooperating with the peripheral surface of the separating roller 23 to define a space A (FIG. 6) which is wedge-shaped in cross section.

The point of abutment between the brake members 85 and the separating roller 23 is chosen to be upstream of a line joining the center of rotation of the separating roller 23 and the unit support shaft 82. While the brake members 85 are rotatable about the support shaft 82 together with the separation unit 8, it should be noted that their point of abutment with the separating roller 23 is located on a locus having a radius R from the support shaft 82. In other words, if the brake members 85 are moved angularly downwardly, they would bite into the separating roller 23. Stated another way, the unit support shaft 82 is located so that the brake members 85 bite into the peripheral surface of the separating roller 23.

A background for the choice of such location of the support shaft 82 will be described briefly. Specifically, if the brake members 85 are allowed to move away from the peripheral surface of the separating roller 23 during a sheet feeding operation, the function of separating sheets into single sheets can be lost. In addition, the separation unit 8 should be disposed so that it can be pivoted upwardly in order to allow a jammed paper to be removed, and to allow a sheet to be fed which does not lend itself to an automatic feed mode. In other words, if the point of abutment between the brake members 85 and the separating roller 23 is located downstream of the line joining the center of rotation of the separating roller 23 and the center of rotation of the support shaft 82, as viewed in the direction in which the sheet advances, when these members cooperate to separate a single sheet, the leading end of a plurality of sheets which find their way into the nip between the brake members 85 and the separating roller 23 may cause the separation unit 8 to be raised upward, acting through the brake members 85. If the separation unit 8 is raised in this manner, a pressure of contact between the brake members 85 and the separating roller 23 can no longer be maintained, giving rise to the likelihood of an overlapping feed. Such situation can be avoided by increasing the resilience of a spring 112 to be described later (FIGS. 5, 8, 15, 16 and 14). However, when the resilience of the spring 112 is increased, problems are presented when moving the separation unit 8 toward or away from the separating roller. Specifically, the unit 8 must be raised with a force of a magnitude which is greater than would be otherwise necessary. Conversely, when moving the unit toward the separating roller, it may be driven very rapidly, causing impacts or the risk that a finger or fingers may be held therebetween. Accordingly, it is desirable that the resilience of the spring 112 be minimized as possible. This explains the significance of the location for the support shaft 82.

The sheet stop 81 is disposed at an angle so that it bears against the leading edge of sheets disposed in a stack on the table 6, displacing the leading edge of successive sheets in a graded manner so that the lowermost sheet is fed first during the automatic feed mode illustrated in FIG. 2. When the sheet stop 81 assumes its position designed for the automatic feed mode, it is spaced from the peripheral surface of the separating roller 23 by a gap which is sufficient to allow the passage of at least one sheet. The stop 81 is secured to the holder 31 while assuring such position. The sheet stop 81 is formed with three holes which permit a screwdriver to pass therethrough for screwing or unscrewing the screws 91 to 93 when a replacement of the brake members 85 is desired.

Mounted on the other surface of the front plate 83*a* is an adjusting mechanism 94 which operates to maintain a constant pressure for the contact for the brake members with the separation roller 23. The mechanism includes a channel-shaped support plate 95, pressure rods 96 extending through the opposite limbs of the support plate 95, a spring 97 disposed on each rod 96 to urge it in a direction to press against the brake members 85, in the manner illustrated in FIG. 2, and a spring abutment 98. The pressure applied to the brake members 85 is suitably chosen by a proper choice of the spring constant of the spring 97.

A pair of side plates 83*c* of the holder 83 are formed with notches 83*d*, in which a frame 99 is secured by means of screws 100, 101. A pair of guide plates 102, 103 are secured to the frame 99 adjacent the opposite ends thereof for guiding the leading edge of a sheet. The guide plates 102, 103 are placed on the top of the table 6 for assuring a proper guidance for the lateral sides of the leading end of the sheet being conveyed toward the sheet delivery guides 21, 22 (FIG. 6). They are formed of a resilient material having a relatively high rigidity. The frame 99 is provided with a pair of longitudinally spaced mounting members 105, 106 which are utilized to attach a level plate 104. A light receiving element $S_{1a}$ forming the first sheet detector $S_1$ (FIG. 2) is fixedly mounted on the mounting member 106. The first sheet detector $S_1$ operates to detect the presence or absence of a sheet on the table 6.

As shown in FIGS. 2 and 8, a unit cover 107 is secured to the frame 99 by a screw 108. The level plate 104 is screwed to the mounting members 105, 106, and is also secured to the unit cover 107 by a countersunk screw 109 as shown in FIG. 2. As shown in FIG. 2, in the automatic feed mode, the level plate 104 is maintained at a given height from the table 6 for restricting the height of the stack of sheets to be placed on the table.

Figure 16:
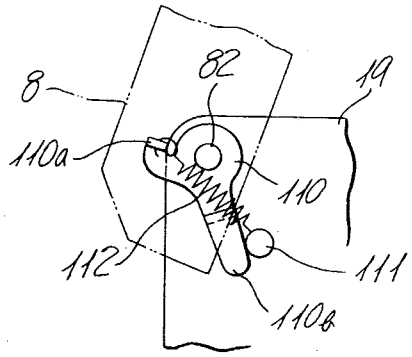
FIGS. 15 and 16 are front views illustrating the construction and the operation of another form of an assembly which maintains the separation unit in each mode.
Figure 15:
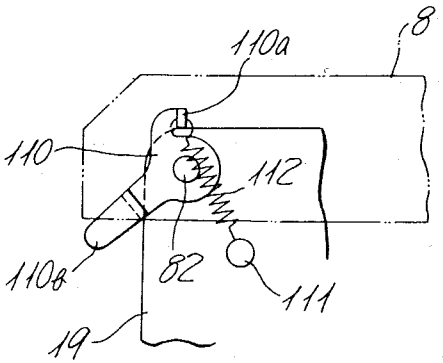

Referring to FIGS. 5, 15 and 16, a holding lever 110 is fixedly mounted on one end of the support shaft 82 for holding the separation unit 8 in a position which is utilized during a manual feed mode. A tension spring 112 extends between a tab 110*a* on the holding lever 110 and a stop pin 111 which is fixedly mounted on the side plate 19 for maintaining the separation unit in the position shown in FIG. 15 during the automatic feed mode. However, when the unit 8 is raised upward to establish the manual feed mode illustrated in FIG. 16, one end 110*b* of the lever bears against the stop pin 111 while the spring 112 moves past the dead center defined by a line between pin 111 and shaft 82, thus maintaining the unit in the position shown in FIG. 16.

Figure 14:
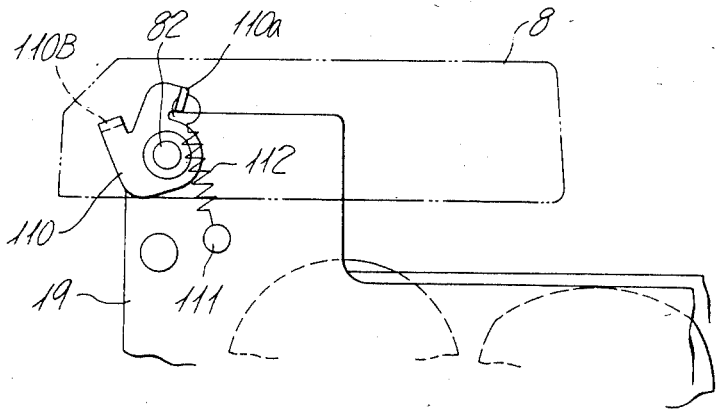
FIG. 14 is a front view of an assembly which maintains an automatic feed mode.

FIGS. 8 and 14 illustrate another form of holding lever. In this instance, one end 110B of the lever represents a stop for engagement with or disengagement from the front edge of the side plate 19. In other respects, the arrangement is similar to the one described above, and therefore will not be described while preserving the same numerals as used before.

Referring to FIG. 2, there is provided a vacuum box 115 which is located below the forward end portion of the table 6 so as to internally house the separating roller 23 and the feed roller 25 therein. A vacuum fan 116 is located below the box 115 and is connected thereto. The vacuum fan 116 is driven to rotate only when the sheets are present on the table 6, thus withdrawing the air through openings 24, 26 formed in the table 6. The air withdrawn is exhausted laterally of the apparatus through exhaust ports 117 (only one being shown in FIG. 5) which are formed in the side plates 19, 20.

It is to be understood that the automatic sheet feeding apparatus is detachably mounted on the body of the facsimile system.

Figure 18:
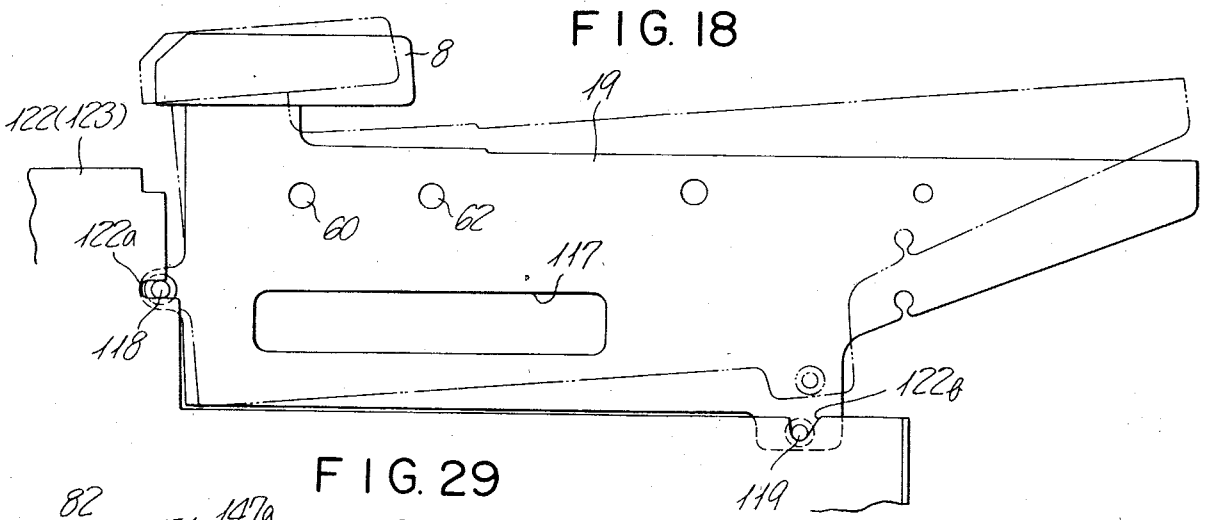
FIG. 18 is a front view of a mounting structure between the automatic sheet feeding apparatus and the facsimile system.

In FIG. 4, a pair of threaded pins 118 and 119 are fixedly mounted on the side plate 19 for positioning purpose. Also positioning pins 120, 121 are fixedly mounted on the other side plate 20, as shown in FIG. 3. As indicated in FIGS. 3 and 18, the body of the facsimile system includes a pair of stationary side plates 122, 123 having positioning notches 122*a*, 122*b* (only shown in FIG. 18) formed therein, which are engaged by these pins, the latter being fixed in position by wing nuts 124, 125 (FIG. 4). By employing such arrangement, the maintenance of the feeding apparatus and the facsimile system is facilitated.

As described previously, the separation unit 8 can be selectively located, by an angular movement about the support shaft 82, to establish the automatic feed mode illustrated in FIGS. 1 and 2 or the manual feed mode illustrated in FIG. 8. During the automatic feed mode, it is necessary to maintain the pressure of contact between the brake members 85 and the separating roller 23 and to maintain the clearance between the sheet stop 81 and the separating roller 23 constant.

Figure 17:
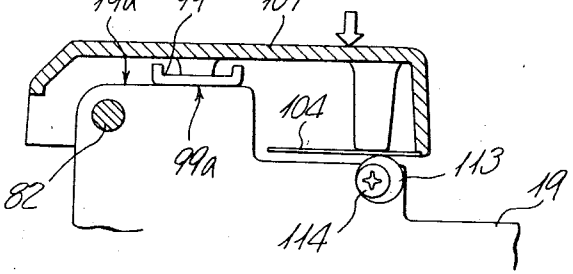
FIG. 17 is a front view, partly in section, of an assembly which protects the separation unit.

In the arrangement shown, the frame 99 includes a bottom side 99*a* which may be disposed in abutment against the upper edges 19*a*, 20*a* of the side plates 19, 20 (FIG. 5), thus allowing the separation unit 8 to be positioned by such abutment and the support shaft 82. With this arrangement, it is possible that the entire separation unit may be distorted when the operator inadvertently pushes or thrusts the unit with his hand. To accommodate for this possibility, an eccentric cam 113 is pivotally mounted on the side plate 19 to bear against the level plate 104, as shown in FIG. 17. This permits any excessive weight applied to the unit to be born by the cam providing a protection of the unit. The eccentric cam 113 is supported by a screw 114, and is fixed after its angular movement is adjusted so that the separation unit 8 is supported at three points including the support shaft 82, the point of abutment between the frame 99 and the upper edge 19*a* of the side plate and the cam 113.

Figure 19:
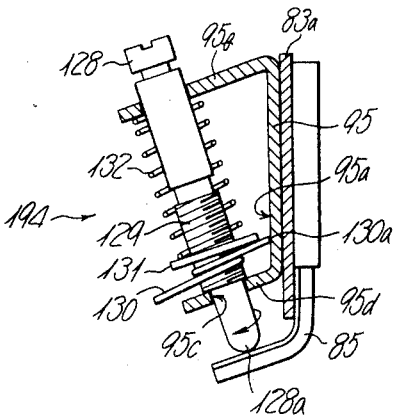
FIGS. 19 and 20 are a front view, partly in section, and a perspective veiw of another form of a pressure adjusting mechanism associated with the brake member.
Figure 20:
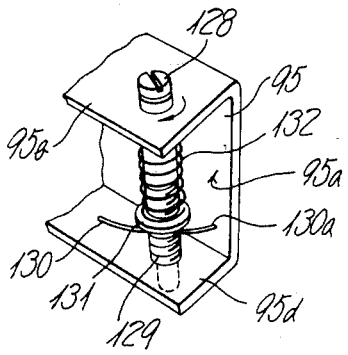

Referring to FIGS. 19 and 20, a modification of the adjusting mechanism which urges the brake members 85 against the separating roller 23 under pressure will be described. This mechanism 194 is constructed to permit the pressure applied by the brake members 85 to be adjusted. It comprises a pressure rod 128 which freely extends through the support plate 95 and which is centrally formed with a threaded portion 129. A steel wire 130 is threadably engaged with the lower end of the threaded portion 129. The steel wire 130 is resiliently urged to be tightly wrapped around the threaded portion over at least one pitch thereof. Both ends or one end 130*a* of the steel wire 130 has a sufficient length to engage a wall 95*a* of the support plate 95 as it is turned about the axis of the pressure rod. A spring abutment 131 is loosely fitted over the pressure rod 128, and a compression spring 132 is disposed on the pressure rod and acts between the spring abutment and a top plate 95*b* of the support plate 95, thus urging the rod to move toward the brake members 85. When the brake members 85 are held apart from the separating roller 23, the movement of the rod under such resilience is limited by the fact that the lower end of the threaded portion 129 is slightly greater than an opening 95*c* formed in the lower limb of the support plate 95. Thus, the rod 128 is urged by the resilience of the spring 132 against the lower limb 95*d*. When the rod 128 is turned in a direction indicated by an arrow, the steel wire 130, which is locked against rotation by the abutment of its end 130*a* against the wall 95*a*, moves upward along the threaded portion 129, thus compressing the spring 132. As a result, the pressure exerted by the spring 132 upon the rod 128 increases. A compression of the spring 132 does not cause a disengagement of the steel wire 130 from the threaded portion. Hence, by turning the rod 128 in the direction indicated by the arrow, the pressure applied to the brake members 85, and hence the pressure of contact between the brake members and the separating roller 23 can be increased. The spring pressure can be reduced by turning the rod 128 in a direction opposite from the direction indicated by the arrow by allowing an extension of the spring 132. Such arrangement provides an advantage that the pressure can be changed without changing the stroke of the pressure rod and that a compact assembly is provided. The stroke of the pressure rod could be maintained by substituting a nut for the steel wire 130. However, the provision of separate means is required which locks it against rotation. In addition, an increased thickness of the nut requires an increased length of the rod, resulting in a bulky assembly.

Figure 21:
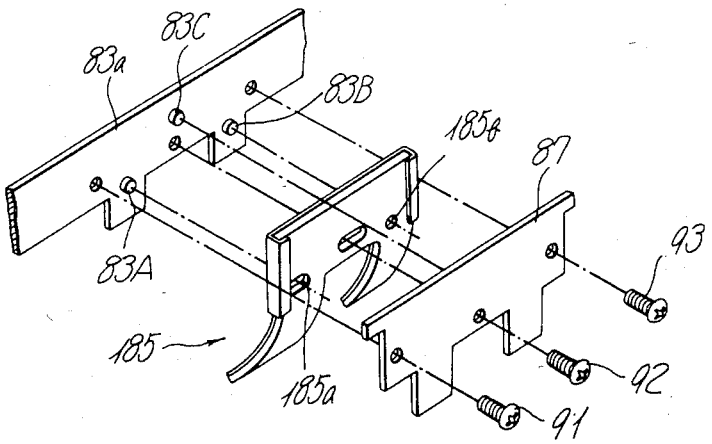
Figure 23:
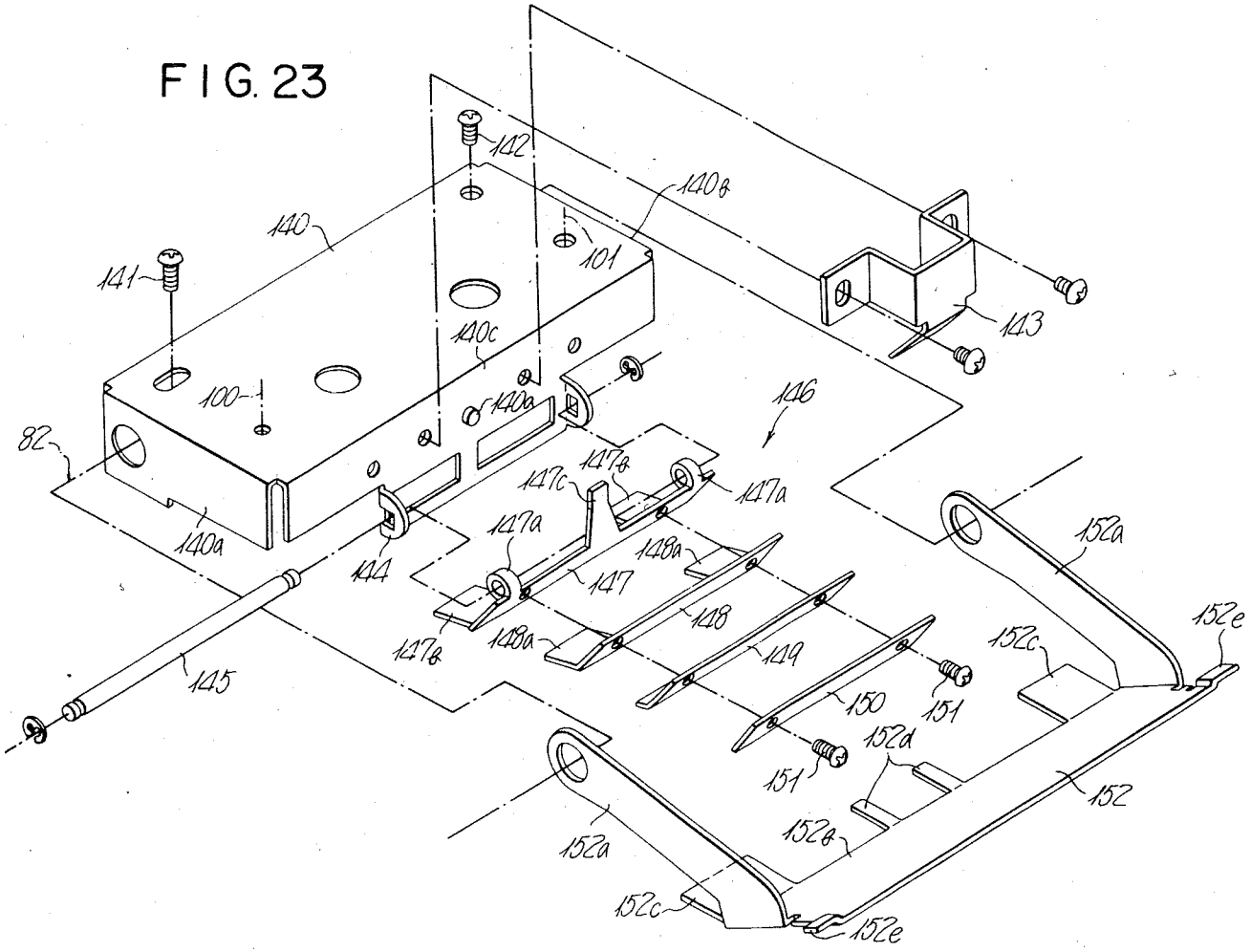
FIG. 23 is an exploded perspective view of another embodiment of brake means.

FIG. 21 shows another form of brake member. In the example shown in FIG. 5, a pair of separate brake members 85 have been used. With this arrangement, while they are located within notches 86*a* formed in the spacer 86, they might angularly move with time about the opening 85*a* (FIG. 22). Hence, when the separation unit 8 is brought to its position assumed during the automatic feed mode, the pressure of contact between the brake members and the separating roller may vary in the axial direction of the separating roller, causing a varying performance of the sheet separation between its left- and and right-hand halves. To overcome this difficulty, an integral brake member 185 shown in FIG. 21 is provided, including both the elastic body and its associated holder. A spacer 86, shown in FIG. 5, which has been used in the previous embodiment to prevent a deformation of the brake member as it is fixed is dispensed with. Instead, projections 83A, 83B, 83C are formed on the front plate 93, and apertures 185*a*, 185*b* formed in the brake member are fitted over the projections 83A, 83B. Subsequently, the mounting plate 87 is threadably engaged with the front plate 83*a* by screws 91, 92, 93, thus securing the brake member in position. It will be noted that the projections 83A, 83B, 83C serve as spacers.

Sheet guide members will now be described together with other embodiments of the brake member and the guide plates 102, 103 as well as level plate 104.

Figure 31:
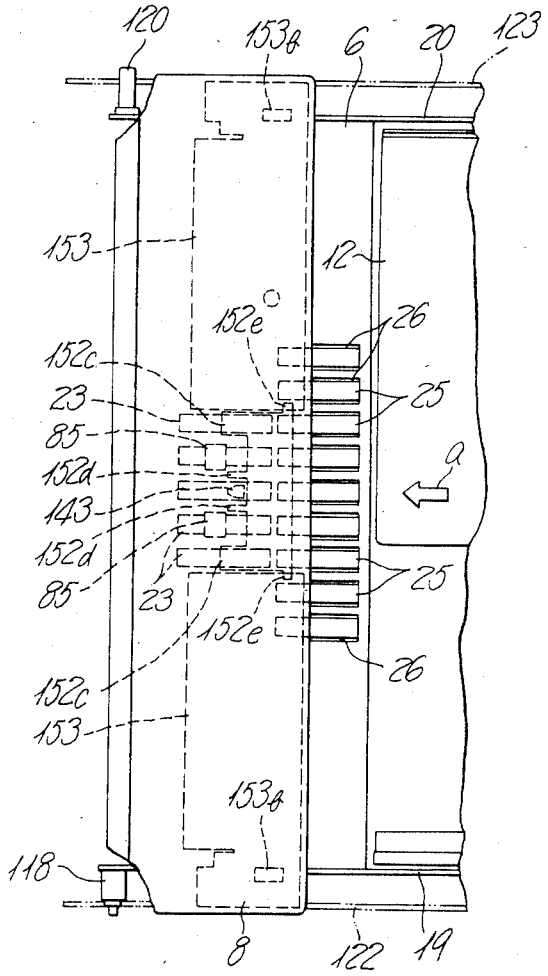
FIG. 31 is a plan view of another form of the separation unit.

Referring to FIGS. 23 to 27, a holder plate 140 which holds the separation unit includes. a pair of lengthwise spaced limbs 140*a*, 140*b* which are bent at right angles to the plane of the plate 140 and in which openings are formed to pass the unit support shaft 82 therethrough. The holder plate 140 is fixedly connected with the support shaft 82 by screws 141, 142. The screws 100, 101 also fixedly mount the frame 99 on the holder plate 140. The holder plate 140 also includes another limb 140*c* which is again bent at right angles to the plane of the plate 140 and to which a stop 143, which functions in the same manner as the sheet stop 81 described above, is secured. The positional relationship between the stop 143 and the separating roller 23 as viewed in plan view is illustrated in FIG. 31.

Figure 24:
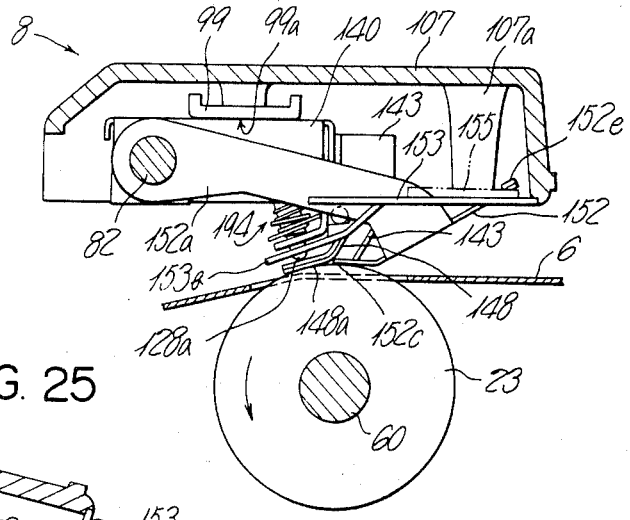
FIG. 24 is a front view, partly in section, of another embodiment of the separation unit, illustrating an automatic feed mode.
Figure 25:
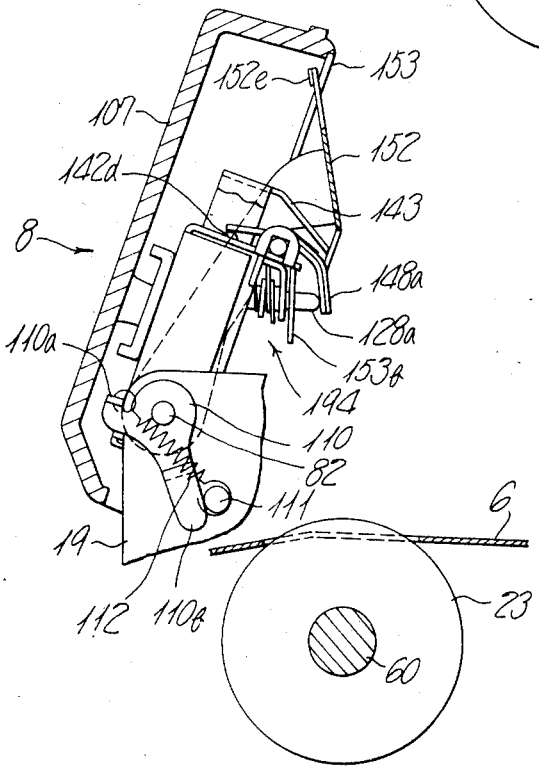
FIG. 25 is a similar front view illustrating a manual feed mode of the separation unit shown in FIG. 24.

Along its lower edge, the limb 140*c* is centrally formed with bearings 144 having square openings formed therein and which are bent from the plane of the limb 140*c*. A support shaft 145 extends through these bearings, and pivotally carries a brake member 146 having a relatively high rigidity. The brake member 146 comprises a rocking member 147 having a pair of loops 147 formed thereon which are loosely fitted over the support shaft 145 to provide a degree of play therebetween, an elastic material 148 such as urethane rubber having a high coefficient of friction and which is applied to the rocking plate, a sheet 149 having a low coefficient of friction which acts to cause the leading end of sheets disposed in the stack to slip into the space between the elastic member 148 and the separating roller 23, and a keeper plate 150, all of which are integrally secured together by a pair of screws 151. It will be noted that along its opposite ends, the lower edge of the rocking plate 147 has an extension extending in the sheet feed direction so as to provide a support for the elastic material 148 as the latter bears against the separating roller 23. It is to be understood that the free end 128*a* of the pressure rod 128 in the adjusting mechanism 194 shown in FIG. 19 abuts against the extension 147*b*. Corresponding extensions 148*a* from the lower edge of the elastic material 148 can be selectively brought into abutment against the separating roller 23. The separation unit can be selectively brought to a position corresponding to the automatic feed mode in which the elastic material 148 abuts against the peripheral surface of the separating roller 23 as shown in FIG. 24, or to a position corresponding to the manual feed mode in which the unit is angularly moved about the support shaft 82 as shown in FIG. 25. In this manual mode, the brake member 146 is driven by the pressure rod 128. When the brake member 146 rocks through an increased stroke in this manner, the leading end of the elastic material 148 may abut against the separating roller 23 as the separation unit is returned to the position corresponding to the automatic feed mode. To prevent such abutment, the limb 140*c* of the holder plate is formed with a stop 140*d* which is selectively engaged by an extension 147*c* extending from the upper edge of the rocking plate 147 at its central position.

Figure 27:
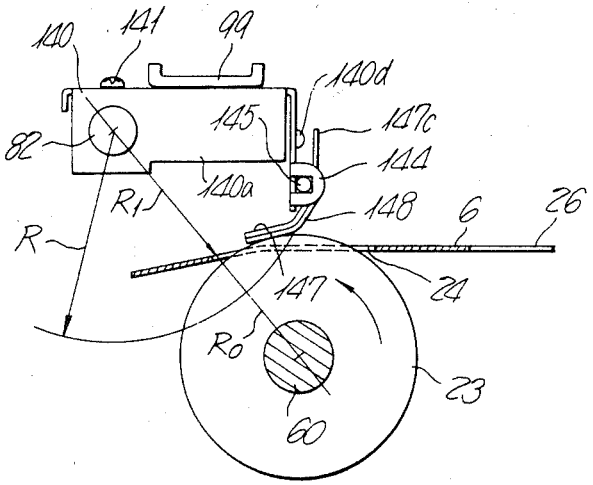
FIG. 27 is a front view of the separating roller and the brake member, illustrating their relative position.

When the separation unit and hence the brake member 146 assume the position corresponding to the automatic feed mode which is shown in FIG. 24, the elastic material 148 bears against the separating roller 23. It will be noted that at this time, the elastic material 148 is located on a locus having a radius R struck from the support shaft 82, as shown in FIG. 27. The radius R is greater than the spacing $R_1$ between the support shaft 82 and the peripheral surface of the separating roller as taken on a line $R_0$ joining the support shaft 82 and the center of rotation of separating roller 23. The point of engagement between the elastic material 148 and the separating roller 23 is located upstream of the line $R_0$ as viewed in the direction of rotation of the roller or in the sheet feed direction. In other words, the support shaft 82, representing the center of rotation of the separation unit or the brake member is located to cause the brake member to assume the above described position.

A sheet guide member 152 includes a pair of arms 152*a* having openings formed in their free end through which the support shaft 82 extends. In this manner, the sheet guide member 152 is rotatably mounted so as to hold the holder plate 140 sandwiched between the arms thereof. The sheet guide member 152 includes a body 152*b* which is disposed at an angle so as to cause the leading end of a lower sheet in the stack to be located forwardly of the leading end of an upper sheet, a pair of keepers 152*c* extending from the lower edge of the body adjacent its opposite ends in the form of the teeth of the comb, and guide elements 152*d*. Experiments have shown that the body 152*b* should be disposed at an angle of about 30 degrees for best results.

Figure 26:
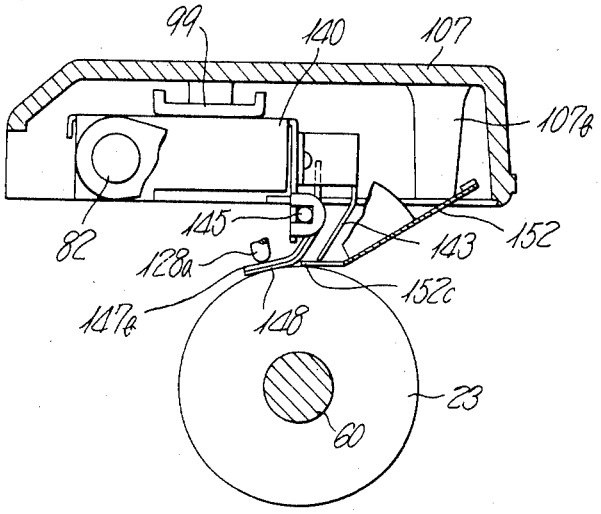
FIG. 26 is a front view of the separation unit shown in FIG. 24, which is partly broken away.

The keepers 152*c* rest, by gravity, on the peripheral surface of those sub-rollers 23 which are located outermost, as shown in FIG. 31. As viewed in the axial direction, the relative position of the keepers 152*c* and the separating roller 23 is such that the free end of the keepers is located slightly upstream, as viewed in the sheet feed direction, of the point of engagement between the elastic material 148 and the separating roller 23, as shown in FIGS. 24 and 26. On the other hand, the guide elements 152*d* are located on the opposite sides of the sheet stop 143, as shown in FIG. 31.

Figure 28:
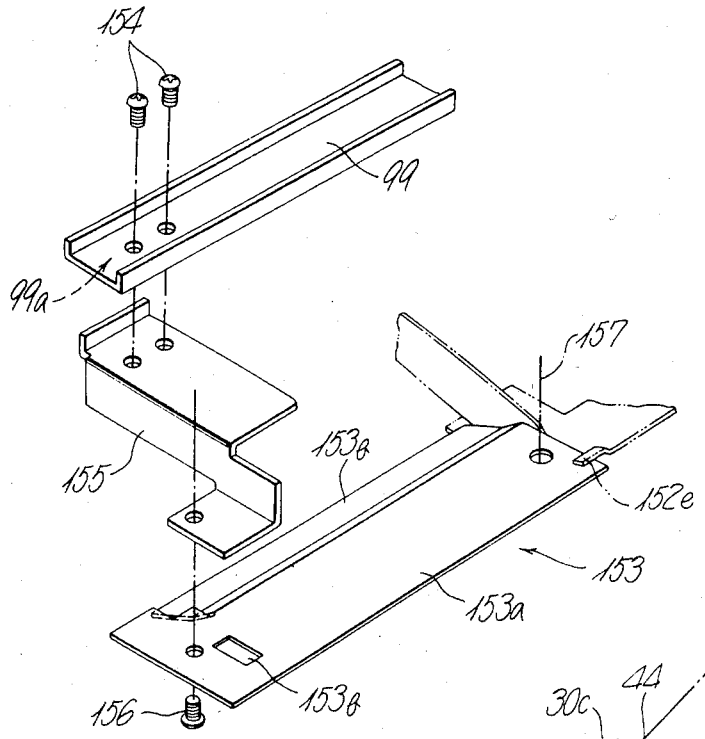
FIG. 28 is an exploded perspective view of the separation unit.

A rocking motion of the sheet guide member 152 in the upward direction is limited by the abutment of the upper edge of the arms 152*a* against the lower surface 99*a* of the frame 99 (FIG. 24) while a rocking motion thereof in the downward direction is limited by the engagement of a pair of detent pieces 152*e*, formed on the opposite ends of the body, with one side of a level guide plate 153 (FIGS. 28 and 31).

Figure 30:
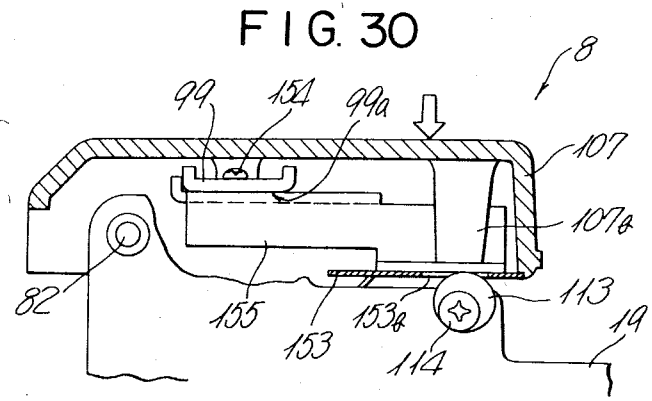
FIG. 30 is a front view, partly in section, illustrating another form of an assembly which protects the separation unit.
Figure 29:
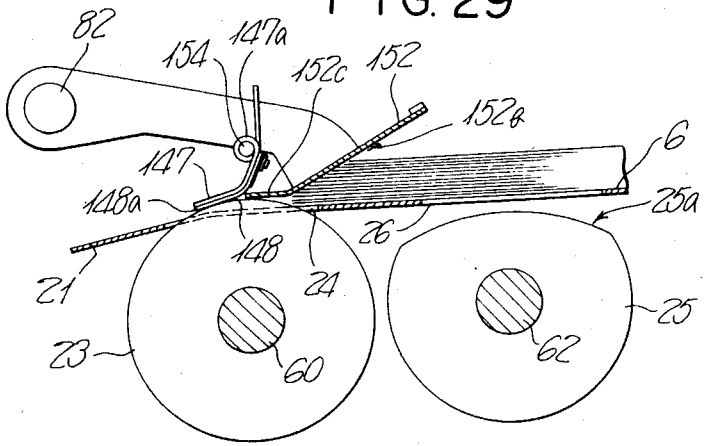
FIG. 29 is a front view illustrating the functioning of the sheet retaining member.

The level guide plate 153 performs the combined functions of the sheet guides 102, 103 and the level plate 104 shown in FIG. 3. It comprises a leveller 153*a* which restricts the height of stack of sheets placed on the table 6, and a guide 153*b* for preventing the lateral edges of a sheet being conveyed from lifting up to assure its smooth movement in to the sheet passage. One end of the level guide plate 153 is secured to a mounting portion 107*a* of the unit cover 107 by countersunk screw 156, together with a support arm 155 which has its other end secured to the end of the frame 99 by screws 154 while the other end of the level guide plate 153 is secured to a mounting portion 107*b* of the unit cover 107 by another countersunk screw 157, as shown in FIGS. 28 and 30. It will be noted from FIG. 31, that a pair of such level guide plates 153 are provided on the opposite side of the brake assembly of the separation unit 8. For ease of illustration, the support arm 155 is only partly shown in FIG. 24.

The level guide plate 153 is formed with a slot 153*c*, through which the eccentric cam 113 projects to bear against the lower surface of the support arm 155 (FIG. 30). The support arm 155 is formed of a material having a relatively high rigidity so as to reinforce the separation unit to provide sufficient strength to with stand impacts which may be produced if the operator inadvertently thrust his hand against the separation unit or when turning the unit from the manual to the automatic feed mode.

It is to be understood that the side plates 19, 20 are connected to the electrical ground. The shaft carrying the pulleys 47, bracket 47*a*, screws 51, 52 and spacers 53, 54 are formed of electrically conductive materials.

Figure 32:
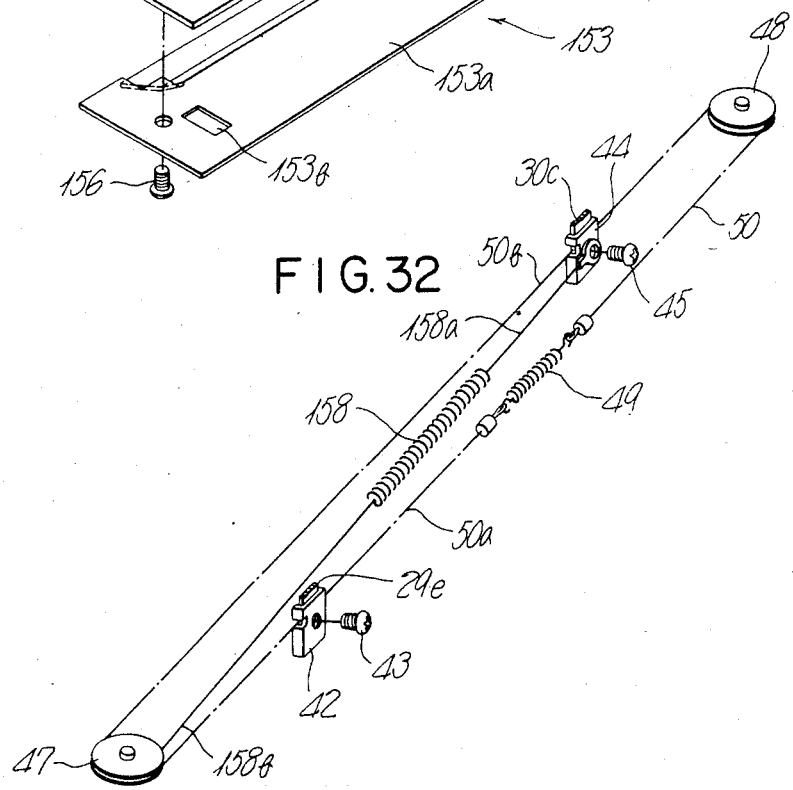
FIG. 32 is a perspective view of another form of means for connecting the lateral sheet guides with the electrical ground.

As shown in FIG. 32, one end 158*a* of a spring 158 which is used for connection with the electrical ground is clamped and secured to the wire anchorage 30*c* on the slide plate 30 by the screw 45, together with the wire 50. The other end 158*b* of the spring 158 is secured to the shaft which carries the pulley 47. The spring 158 is formed of an electrically conductive material such as a wire of phosphor bronze or stainless steel wire, and has a relatively low resilience. When the spring 158 extends between one of the slide plates, 30, and the side plate 19 which is disposed on the opposite side as in the embodiment shown, one of the cross sheet guides, 12, will be urged toward the side plate 19. Stated differently, the cross sheet guides 11, 12 will be urged toward each other. However, such resilience is less than the resistance which the slide plate 29, 30 experience during their sliding movement, and hence no movement of guides 11, 12 occurs. Stated differently, the resilience of the spring 158 is chosen to avoid a movement of the cross sheet guides 11, 12 toward each other.

In the described embodiment, one end of the spring which utilized for connection with the electrical ground is connected to the side plate 19 through the bracket 47*a* (FIG. 5) which is provided to mount a pulley thereon. However, the spring may be directly connected to the side plate.

When the cross sheet guides are connected to the electrical ground through the slide plates and the spring, there is no static electricity which remains on these guides, completely preventing any electric shock or uncomfortability which may be applied to the operator. It will be noted that cross sheet guides are connected to the electrical ground directly without recourse to a sliding contact, whereby a maximum effect is achieved to establish a potential which is very close to the ground potential.

The connection of the cross sheet guide and the side plate by means of the spring urges the cross sheet guides toward each other, which is effective to prevent an unintended movement of a sheet in response to shocks applied during the operation of the apparatus. Specifically, the spring 158 urges the cross sheet guides 11, 12 toward each other while it is subject to the resistance presented by the slide plates. Accordingly, if an external force is applied to move the guides 11, 12 apart, the effect of such force can be effectively suppressed. In this manner, an original to be transmitted which is placed on the table can be prevented from skewing.

In the embodiment described above, the spring 158 extends only between the cross sheet guide 12 and the side plate 19, but it should be understood that another spring may be provided between the other cross sheet guide 11 and the side plate 20. The spring 158 may be formed by a helical spring either partially as shown or entirely.

The operation of the automatic sheet feeding apparatus will now be described. Since the apparatus is capable of assuming an automatic feed mode and a manual feed mode selectively, these modes will be separately described.

1. Automatic Feed Mode

In this mode, a number of sheets are placed in a stack on the table 6, and are automatically separated into single sheets and fed.

Initially, the cross sheet guides are located in accordance with the size of sheets being fed. In FIG. 1, the cross sheet guides 11, 12 are located so as to guide sheets of the A3 size which represents the maximum size available in the apparatus. As shown in FIG. 9, this position is maintained by the engagement of the positioning pawl 40*b* on the positioning member 40 with the peripheral groove A3. Hence, if it is attempted to move the cross sheet guides under this condition, they cannot be moved. When it is desired to feed sheets of the A4 size lengthwise, the click stop action is released. Specifically, the release knob 46 is moved to the left, as viewed in FIGS. 9 and 10, causing the slide plate 44 to move in the same direction. The sliding movement of the slide plate 44 causes the projection 44C to rock the rockable member 39 clockwise about the stub shaft 38. As shown in FIG. 4, one end 39*b* of the rockable member 39 is bent toward the projection 44C in order to maintain its engagement with this projection.

Figure 12:
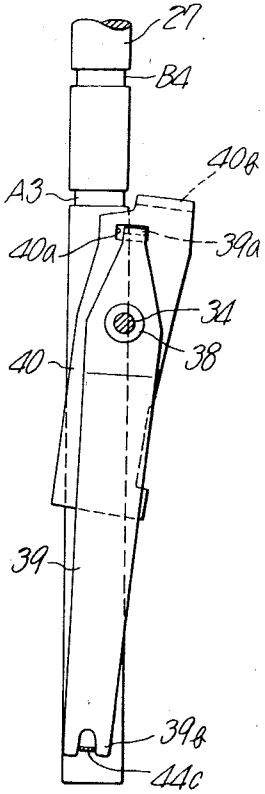
FIGS. 12 and 13 are similar views to FIG. 11 illustrating the operation of the mechanism.
Figure 13:
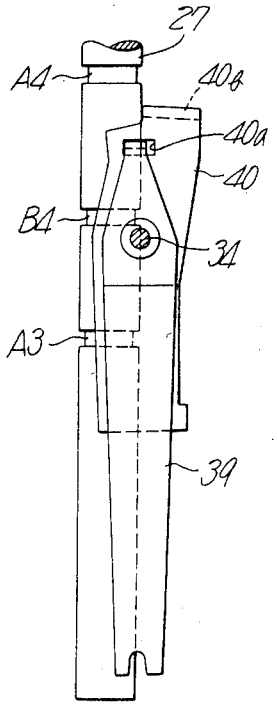

As the rockable member 39 rocks, its end 39*a* causes the positioning member 40 to rock about the stub shaft 38 and against the resilience of the spring 41 (FIG. 9), as indicated in FIG. 12, thus allowing the pawl 40*b* to be disengaged from the peripheral groove A3. This releases the click stop action upon the cross sheet guides 11, 12. While maintaining the release knob 46 to the left, the cross sheet guide 11 is then moved toward the center of the table 6, and the release knob 46 is released at a suitable position of the guide. Thereupon, the positioning member 40 rocks under the resilience of the spring 41 (FIG. 9) in the manner indicated in FIG. 13, causing the positioning pawl 40*b* to bear against the periperal surface of the guide shaft 27. As the cross sheet guide 11 is allowed to slide further while maintaining the condition shown in FIG. 13, the positioning pawl 40*b* becomes engaged with the peripheral groove A4. The cross sheet guide 11 is then held in a position, by the click stop action, where it guides one lateral side of sheet of the A4 size.

On the other hand, since the cross sheet guide 12 is interconnected with the cross sheet guide 11 through the pulley and the wire 50, it moves through the same distance, but in the opposite direction as the guide 11 moves. When the guide 11 is held by the click stop action, the guide 12 also comes to a stop at the position which is reached. This position allows the guide 12 to guide the other lateral side of sheets of the A4 size.

The cross sheet guides 11, 12 are held, by the click stop action, at positions where they guide the lateral sides of the sheet of the A4 size. However, it should be noted that these guides are capable of guiding both of the lateral edges of sheets which have been cut to size. Although a majority of sheets are cut to size, there are some sheets which are not cut to size. For such sheets, after the sheets are placed on the table 6, the click stop action is released, and then without causing the positioning pawl 40*b* to be engaged with one of the peipheral grooves, the cross sheet guides 11, 12 are brought into alignment with both lateral edges of the sheets. The guides 11, 12 are left without the click stop action.

When the cross sheet guides are located in the manner mentioned above, sheets may be placed in a stack on the table. At this time, the height of the stack is restricted by the level plate 104 which forms the bottom plate of the separation unit 8. Specifically, the quantity of sheets placed on the table 6 is limited to that amount which can be placed between the table 6 and the level plate 104 with some clearance. The height of the level plate 104 as measured from the table 6 is determined by the capacity of the feeding apparatus. However, the apparatus is designed to allow fifty sheets, for example, to be set in place if the stack of sheets includes slightly curled or wrinkles sheets. In FIG. 2, when setting sheets, they are inserted between the table 6 and the level plate 104 in a direction a1 which is substantially parallel to the sheet feed direction a (FIGS. 1 and 3). In this manner, the height of the stack of sheets is restrcited, preventing sheets from being stacked beyond such height.

When loading sheets in the direction a1, the sheets are caused to slip over the surface 6*b* of the table 6 until their leading end bears against the sheets stop 81, with the leading ends of the successive sheets being staggered stepwise so that the lower sheet has its leading end located forwardly of the upper sheet. At this time, the peripheral surface of the feed roller 25 does not project above the surface 6*b*, so that if lower sheets are curled downwardly, their leading end cannot thrust against the roller to be folded thereby when forming the stack.

When the sheets are loaded, the transmission button 126 (FIG. 1) may be depressed. A signal which is produced by such depression causes the drive motor 77 (FIG. 6) and the vacuum fan 116 (FIG. 2) to begin their rotation. Referring to FIG. 6, the rotation of the drive motor 77 causes the gears 64, 70 to rotate in the sheet feed direction. However, the clutch mechanism prevent their rotation from being transmitted to the separating roller 23 and the feed roller 25. The vacuum fan 116 withdraws the air through the openings 24, 26 formed in the table 6, thus attracting a lowermost one of the sheets in the stack against the table 6. Simultaneously with the depression of the transmission button 116 or after a time delay corresponding to the start-up of the vacuum fan 116, the solenoid 68 is energized, whereupon the detent lever 67 which locks the ratchet wheel 65 to rock clockwise as shown in FIG. 6, allowing the rotation of the gear 64 to be transmitted to the support shaft 60, which in turn causes the separating roller 23 to rotate in the sheet feed direction.

On the other hand, simultaneously with the energization of the solenoid 68, the solenoid 74 is also energized, disengaging the detent lever 72 from the engaging portion 71*a* of the flange 71. This permits the rotation of the gear 70 to be transmitted to the support shaft 62, which in turn causes the feed roller 25 to rotate in the sheet feed direction. The purpose of energizing the solenoid 74 is merely to cause a rocking motion of the detent lever 72 to disengage its detent piece 72*a* from the engaging portion 71*a* of the flange 71. Consequently, the solenoid 74 is turned off after disengagement therebetween occurs. The detent lever 72 then rocks under the resilience of the spring 73 after it has released the flange, bringing its detent piece 72*a* into abutment against the peripheral edge of the rotating flange.

A bundle of sheets including the lowermost sheet which is attracted to the table 6 begins to be fed to the left, as viewed in FIG. 2, as a result of the friction with the rotating separating roller 23 and the rotating feed roller 25, the roller surface of which other than the hiatus area then projects above the sheet receiving surface as a result of its rotation. In this instance, the principal force of friction is supplied by the feed roller. A reduced number of sheets including the lowermost one pass through the clearance between the peripheral surface of the separating roller 23 and the sheet stop 81 (143) to have their leading end advanced into the wedge-shaped space A (FIG. 6) defined by the peripheral surface of the separating roller and the brake members 85.

At this time, the sheet guide member 152 assists in achieving an ideal planarity in the sheets and also locates them so that a lower sheet has its leading end disposed forwardly of the leading end of an upper sheet, thus allowing a smooth advancement into the wedge-shaped space. As a few sheets including the lowermost one moves forward, those sheets which are located above them will follow the first mentioned sheets in the same direction though through a small distance as a result of the friction between the adjacent sheets. However, the sheet guide member 152 is free to retract upwardly so as to avoid any deformation of the leading end of the following sheets. If the sheet stop 81 successfully operates to allow only the lowermost sheet to advance into the wedge-shaped space A, there is no problem whatsoever. However, if a plurality of sheets advance into this space, the lowermost sheet will continue to be conveyed to the left, as viewed in FIG. 2, by friction with the rotating separating roller 23 while upper sheets are held sationary by friction with the brake members 85 which are abutting against the separating roller. The inclined disposition of the sheet stop 81 assists in the stepwise offset or staggering between the leading ends of the plurality of sheets within the wedge-shaped space A, allowing the lower sheet to have its leading end located forwardly than the remainder.

The guide elements 152*d* of the sheet guide member 152 which are located on the opposite sides of the sheet stop operate to cause the sheet to pass below the lower end of the sheet stop, thus preventing the leading end of the sheet from being folded back by the presence of the sheet stop. The keepers 152*c* of the sheet guide member 152 operate to urge the sheet aginst the separating roller 23, thus assisting in increasing its friction with the roller to assure a reliable separation and sheet feeding.

When the brake member illustrated in FIGS. 23 to 27 is utilized, the fact that the brake member 146 is mounted in a manner to permit a degree of play allows any tolerance in the accuracy of parts or in the assembly to be accommodated for, allowing this member to abut against the separating roller 23 with a uniform pressure, without producing any unbalanced bias. Hence, the pressure applied to the sheets being separated is balanced crosswise, avoiding a skew. The fact that the brake member 146 is mounted in a rockable manner prevents any oscillation caused to the brake member as a result of the sliding contact of the sheet being conveyed with the brake plate 148 from being transmitted to outer fixed members, thus avoiding the occurrence of offensive sound of oscillations.

The sheet which has been separated by friction with the separating roller 23 and the brake members 85 is conveyed by the roller 23 and the feed roller 25 in the direction of the tangential line l (FIG. 2) between the roller 23 and the brake members. At this time, the lower and the upper sheet delivery guide 21, 22, which are disposed substantially in parallel relationship with the tangential line, allow the advancing sheet to be conveyed smoothly without abutment against any guide plate which defines the sheet passage.

The sheet which is being conveyed between the separating roller 23 and the brake members 85 will drag the brake members 85 in a direction to bite into the peripheral surface of the separating roller 23 in accordance with the relative position between the point of abutment between the roller 23 and the brake members and the unit support shaft 82, thus assisting in the functioning of the brake members. Consequently, the brake members 85 cannot move away from the peripheral surface of the separating roller, standing in the way of other sheets than the lowermost one, assuring a reliable separation.

As the sheet is being conveyed by the feed roller 25, the leading end of the sheet is braked by friction with the brake member 85 in the process that the sheet is separated by the action of the separating roller 23 and the brake members 85. This results in a lagging in the feed rate of the leading end as compared with the feed rate by the feed roller 25. However, such lagging can be immediately removed inasmuch as the sheet conveying speed of the separating roller 23 is initially chosen to be greater than that of the feed roller 25. As a consequence, the sheet can be fed without becoming folded between the feed roller 25 and the separating roller 23. Neither skew nor sliding contact of the image surface with the separating roller occurs. The fact that the peripheral speed of the separating roller 23 exceeds that of the feed roller 25 means that the sheet is conveyed by the separating roller 23. Since the clutch 69 is interposed between the support shaft 62 for the feed roller 25 and the gear 70, the feed roller 25 rotates in following relationship with the movement of the sheet.

Referring to FIG. 2, when the leading end of the advancing sheet is detected by the second sheet detector $S_2$, its signal causes the first and the second scanner roller pair 17, 18 to rotate, thus receiving and feeding the advancing sheet therebetween. As the leading end of the sheet is being held between the first roller pair 17, the feed roller 25 has just completed one revolution, and is no longer driven as a result of the flange 71 being locked by the detent lever 72, whereby it comes to a stop with its hiatus area 25*a* located upside, as shown in FIG. 2.

As the sheet continues to advance through the sheet passage 13 and its leading end is detected by the third sheet detector $S_3$, its signal deenergizes the solenoid 68. Thereupon the separating roller 23 which has been rotating is no longer driven since the ratchet wheel 65 is locked by the detent lever 67. At a given time interval after the detection signal from the detector $S_3$, or when the leading end of the sheet has moved over a suitable point on the target glass 16, the drive to the first and the second scanner roller pair 17, 18 is interrupted. At this time, the separating roller 23 rotates in following relationship with the sheet which is being conveyed by the scanner roller pairs by the action of the one-way clutch 61 (FIG. 7) which is interposed between the separating roller 23 and the support shaft 60.

When the scanner roller pairs come to a stop, the sheet conveying operation is interrupted. However, a signal indicating the initiation of a transmission is sent to the receiving end at the same time as the roller pairs stop, and the apparatus enters a standby mode until the receiving end is prepared. In response to a signal from the receiving end, the first and the second scanner roller pair 17, 18 resume their rotation to feed the sheet stepwise for allowing a reader, not shown, to read picture information. The picture information is converted into a corresponding electrical signal which is transmitted to the receiving end.

After the reading operation, the sheet is delivered onto the original stacking tray 9 (FIG. 1). As the trailing end of the sheet being read is detected by the second sheet detector $S_2$, the solenoids 68, 74 are energized again to cause a rotation of the separating roller 23 and the feed roller 25 in the same manner as mentioned previously, thus starting a separation and a feed operation for the next following sheet.

Sheets disposed in a stack on the table 6 have their leading end brought into abutment against the sheet stop 81 by friction with the rotating separating roller 23 and the feed roller 25, and the leading end passes between the sheet stop 81 and the separating roller 23 to be fed into the nip between the separating roller 23 and the brake members 85 which are crosswise centrally located. It will be recognized that sheets in the stack contain a degree of wrinkles and curls. Consequently, as the sheets advance under the action of these rollers, the central area of the leading end will be guided downward along the sheet guidme member 152 and the sheet stop 81 (143), but there is no guiding action along both of their lateral edges, so that the sheets will generally assume a centrally depressed configuration, as viewed in the sheet feed direction. If the central area of the sheet is allowed to move into the nip between the separating roller 23 and the brake members 85 under such condition, both lateral edges of the leading end may be hindered by the upper sheet delivery guide 22. Such difficulty is avoided by the provision of the guide plates 102, 103 (FIGS. 3, 5 and 6) or the guide elements 153*b* of the level guide plate 153 (FIGS. 24 and 28) which operate to guide both lateral edges of sheets.

If sheets placed on the table 6 are of a greater size such the A3 size, their trailing end will be located out of the table. Accordingly, the auxiliary table 7 (FIG. 1) is utilized. Such sheet of a greater size move over the auxiliary sheet feed rollers 59 which are rotatably mounted on the auxiliary table, so that the increased weight of the sheets cannot present an increasing loading upon the separating roller 23 and the feed roller 25.

2. Manual Feed Mode

This mode is utilized for feeding sheets which cannot be or do not lend themselves to be fed by the automatic feed mode. Attributes which characterize such sheets are wrinkles, curls, another sheet or label applied, perforations breakages and very reduced or increased thickness. Sheets containing these attributes cannot be subject to a separation and feeding by the cooperation of the separating roller and the brake members, but must be fed utilizing a carrier sheet or by manually correcting the wrinkles or curls by the operator.

At this time, the separation unit 8 is turned upside about the unit support shaft 82 to assume a position shown in FIG. 8 in which it is maintained. Consequently, the inlet opening of the sheet passage defined by the lower and the upper sheet delivery guide 21, 22 is exposed in proximity to the front end of the table. The sheet passage defined by the guides 21, 22 will be referred to herein as a manual feed passage 127 which is utilized during the manual feed mode.

A sheet is manually inserted into the inlet opening 127*a* of the manual feed passage 127. As the leading end of the sheet is detected by the second sheet detector $S_2$, its signal cuases the first and the second scanner roller pair 17, 18 to rotate, whereupon the sheet can be advanced further forward to be fed into the nip between the roller pair 17. As the sheet is conveyed to the first roller pair 17, the sheet may be released. When the leading end of the sheet is detected by the third sheet detector $S_3$, the drive to the scanner roller pair is interrupted at a given time interval after the occurrence of such detection, and the apparatus enters a standby mode until the receiving end is prepared, generally in the same manner as in the automatic feed mode. Consequently, subsequent operation will not be described.

It will be noted when the separation unit is brought to a position corresponding to the manual feed mode, the manual feed passage is established, and there is nothing which stands in the way to this passage. Accordingly, a sheet can be smoothly inserted into the passage. The fact that the separation unit 8 can be selectively brought to positions corresponding to the automatic and the manual feed mode advantageously permits a removal of a jammed sheet between the brake members and the separating roller during the automatic feed mode.

What is claimed is:

1. An automatic sheet feeding apparatus comprising:

a sheet receiving table for receiving sheets placed in a stack;

a separating roller disposed adjacent the front end of the table and having its peripheral surface partly projecting above the sheet receiving surface of the table;

drive means for driving the separating roller for rotation in a sheet feed direction;

brake means including at least one brake member disposed in abutment against the peripheral surface of the separating roller;

a sheet passage for guiding a sheet delivered by the separating roller;

a separation unit carrying the brake member; and means for moving the separation unit toward or away from the table to bring the separation unit selectively into a first position corresponding to an automatic feed mode in which the brake member is brought into abutment against the separating roller and a second position corresponding to a manual feed mode in which the brake member is moved away from the separting roller such that one end of the sheet passage is opened to define a manual of feed passage through which sheets can be inserted manually to said separating roller;

wherein the separation unit is pivotally supported by a pair of side plates utilizing a single support shaft, the unit including a frame, the opposite ends of which are disposed in abutment against the top of the pair of side plates, the bottom of the opposite ends of the unit being disposed in abutment against protection mechanism provided on the respective side plates.

2. An apparatus according to claim 1 in which the protecting mechanism comprises an eccentric cam connected to the side plate, the separation unit abutting against the cam edge of the eccentric cam.

3. An automatic sheet feeding apparatus comprising:

a sheet receiving table for receiving sheets placed in a stack;

a separating roller disposed adjacent the front end of the table and havings its peripheral surface partly projecting above the sheet receiving surface of the table;

drive means for driving the separating roller for rotation in a sheet direction;

brake means including at least one brake member disposed in abutment against the peripheral surface of the separating roller;

a sheet passage for guiding a sheet delivered by the separating roller;

a separation unit carrying the brake member; and means for moving the separation unit toward or away from the table to bring the separation unit selectively into a first position corresponsing to an automatic feed mode in which the brake member is brought into abutment against the separating roller and a second position corresponding to a manual feed mode in which the brake member is moved away from the separating roller such that one end of the sheet passage is opened to define a manual feed passage through which sheets can be inserted manually to said separating roller;

wherein the table includes a pair of cross sheet guides lying in a central recess of the table for forming part of the receiving surface and operating to guide the opposite lateral edges of the sheets, means including a guide shaft for supporting the cross sheet guides so they can be moved in a direction perpendicular to the sheet feed direction, connecting means for simultaneously moving the pair of cross sheet guides in opposite directions, positioning means for selectively maintaining the cross sheet guides, by a click stop action, at selected positions on the guide shaft which correspond to the location of the lateral edges of sheets or a plurality of different widths, and release means for releasing the click stop action of the positioning mechanism;

wherein the release means comprises a rockable member engaged with the positioning means, a slide plate engaged with the rockable member and slidable along the guide portion of one of the cross sheet guides which guides a lateral edge of the sheets, and a release knob substantially integral with the slide plate.

4. An apparatus according to claim 3 in which the rockable member is formed by a leaf spring having its end which is adapted to engage the slide plate urged for engagement with the latter.

5. An apparatus according to claim 3 in which the release means releases the click stop action as the release knob is moved in the same direction as the sheet feed direction.

6. An automatic sheet feeding apparatus comprising:

a sheet receiving table for receiving sheets placed in a stack;

a separating roller disposed adjacent the front end of the table and having its peripheral surface partly projecting above the sheet receiving surface of the table;

feed means including a feed roller located upstream, relative to a sheet feed direction, of the separating roller and adapted to be driven for rotation in the sheet feed direction, drive means for driving the separating roller for rotation in the sheet feed direction;

brake means including at least one brake member disposed for abutment against the peripheral surface of the separating roller;

a sheet passage for guiding a sheet which is delivered by the separating roller;

a separation unit carrying the brake member; and means for moving the separation unit toward or away from the table to bring the separation unit selectively into a first position corresponding to an automatic feed mode in which the brake member is disposed in abutment against the separating roller and into a second position corresponding to a manual feed mode in which the brake member is moved away from the separting roller to open one end of the sheet passage to thereby define a manual feed passage so that sheets can be inserted manually to said separating roller;

wherein the separation unit is pivotally supported by a pair of side plates utilizing a single support shaft, the unit including a frame, the opposite ends of which are disposed in abutment against the top edge of the pair of side plates, the bottom of the opposite ends of the unit being disposed in abutment against protection mechanism provided on the respective side plates.

7. An apparatus according to claim 6 in which the protecting mechanism comprises an eccentric cam connected to the side plate, the separation unit abutting against the cam edge of the eccentric cam.

8. An automatic sheet feeding apparatus comprising:

a sheet receiving table for receiying sheets placed in a stack;

a separating roller disposed adjacent the front end of the table and having its peripheral surface partly projecting above the sheet receiving surface of the table;

feed means including a feed roller located upstream, relative to a sheet feed direction, of the separating roller and adapted to be driven for rotation in the sheet feed direction, drive means for driving the separating roller for rotation in the sheet feed direction;

brake means including at least one brake member disposed for abutment against the peripheral surface of the separating roller;

a sheet passage for guiding a sheet which is delivered by the separating roller;

a separation unit carrying the brake member; and means for moving the separation unit toward or away from the table to bring the separation unit selectively into a second position corresponding to an automatic feed mod in which the brake member is moved away from the separating roller to open one end of the sheet passage to thereby define a manual feed passage so that sheets can be inserted manually to said separating roller;

wherein the table comprises a pair of cross sheet guides forming part of the receiving surface and operating to guide the opposite lateral edges of the sheets, a guide shaft for supporting the cross sheet guides to be movable in a direction perpendicular to the sheet feed direction, connecting means for causing a movement of the pair of cross sheet guides in opposite directions simultaneously, a positioning mechanism for selectively maintaining the cross sheet guides, by a click stop action, at selected positions on the guide shaft which correspond to the location of the lateral edges of sheets of a plurality of different widths, and a release mechanism for releasing the click stop action of the positioning mechanism; and wherein the release mechanism comprises a rockable member engaged with the positioning member of the positioning mechanism, a slide plate engaged with the rockable member and slidable along a guide portion of one of the cross sheet guides which guides a lateral edge of sheets, and a release knob substantially integral with the slide plate.

9. An apparatus according to claim 8 in which the rockable member is formed by a leaf spring having its end which is adapted to engage the slide plate urged for engagement with the latter.

10. An apparatus according to claim 8 in which the release mechanism releases by a click stop action as the release knob is moved in the same direction as the sheet feed direction.

* * * * *